US008578921B2

(12) United States Patent
Macy

(10) Patent No.: US 8,578,921 B2
(45) Date of Patent: Nov. 12, 2013

(54) METHOD AND APPARATUS FOR CHANNELING AIR LINE INSIDE OF PAINTBALL ASSEMBLY HAVING A TRANSFER ROD

(75) Inventor: Omar Alonso Macy, San Jose, CA (US)

(73) Assignee: Rem Action Paintball, Inc., San Jose, CA (US)

( * ) Notice: Subject to any disclaimer, the term of this patent is extended or adjusted under 35 U.S.C. 154(b) by 336 days.

(21) Appl. No.: 12/987,036

(22) Filed: Jan. 7, 2011

(65) Prior Publication Data

US 2012/0060814 A1 Mar. 15, 2012

Related U.S. Application Data

(63) Continuation-in-part of application No. 12/882,190, filed on Sep. 14, 2010, now Pat. No. 8,166,961.

(51) Int. Cl.
*F41B 11/06* (2006.01)

(52) U.S. Cl.
USPC ..... 124/73

(58) Field of Classification Search
USPC ..... 124/72–77
See application file for complete search history.

(56) References Cited

U.S. PATENT DOCUMENTS

| | | | | |
|---|---|---|---|---|
| 4,819,609 | A * | 4/1989 | Tippmann | 124/72 |
| 5,722,383 | A * | 3/1998 | Tippmann et al. | 124/76 |
| 7,065,914 | B1 * | 6/2006 | Wagner, II | 42/73 |
| 7,770,571 | B2 * | 8/2010 | Tippmann et al. | 124/73 |
| 8,333,181 | B1 * | 12/2012 | Rice | 124/73 |
| 2003/0056778 | A1 * | 3/2003 | Schavone | 124/74 |
| 2008/0060630 | A1 * | 3/2008 | Halmone | 124/73 |
| 2008/0078971 | A1 * | 4/2008 | Quinn et al. | 251/205 |
| 2009/0114201 | A1 * | 5/2009 | Halmone | 124/74 |
| 2009/0194088 | A1 * | 8/2009 | Tippmann et al. | 124/74 |

* cited by examiner

*Primary Examiner* — Michael Carone
*Assistant Examiner* — Reginald Tillman, Jr.
(74) *Attorney, Agent, or Firm* — James M. Wu; JW Law Group

(57) ABSTRACT

A paintball assembly capable of channeling air line or pipe inside of the paintball assembly using a transfer rod is disclosed. The assembly includes a main valve, an air pipe, a bolt, a hammer, and a U-shaped rod. While the main valve is configured to propel a paintball utilizing pressurized gas, the air pipe supplies and channels the pressurized gas to the main valve. The bolt guides or pushes the paintball into a firing chamber, and the hammer manages or controls the main valve for propelling the paintball upon pulling of the trigger. The U-shaped rod is used to synchronize the movement of the bolt and the hammer. In one embodiment, the U-shaped rod is configured in such a way that at least a portion of the U-shaped rod is structured around the air pipe to reduce contact with the air pipe.

19 Claims, 24 Drawing Sheets

METHOD AND APPARATUS FOR CHANNELING AIR LINE INSIDE OF PAINTBALL ASSEMBLY HAVING A TRANSFER ROD

PRIORITY

This application is a continuation-in-part of U.S. patent application Ser. No. 12/882,190, filed on Sep. 14, 2010 in the name of the same inventor and entitled "OPTIONAL LOADING MECHANISM CAPABLE OF RETROFITTING PAINTBALL ASSEMBLY," hereby incorporated into the present application by reference.

FIELD

The present invention relates to paint ball guns. More specifically, the present invention relates to paint ball and/or projectile propelling systems.

BACKGROUND

With increasing popularity of paintball tournaments as well as professional trainings such as military and sports competitions, more accurate and realistic looking paintball guns or markers are in demand. For example, the success of training or competition depends on how quickly an operator of a paintball marker can eliminate opponents by hitting them with paintballs or paint projectiles. A problem associated with a conventional paintball marker or gun is that the accuracy of paintball marker is relatively poor partially due to the traditional design of the paintball guns or markers.

A conventional paintball gun or marker, for example, channels pressurized gas to the firing mechanism from bottom side of a marker. A typical gas tank or canister is mounted underneath the grip with a hose circles around the trigger. The gas tank, which is typically mounted below the paintball gun or receiver, can be bulky and heavy at an awkward location which can hamper maneuver or movement of an operator.

Another problem associated with a conventional paintball marker or gun with a gas tank mounted underneath of the receiver is that handling of a typical paintball gun deviates from handling of a real gun whereby using paintball marker as firearm training exercise degrades the effectiveness of military and/or police field training.

SUMMARY

Embodiments of the present invention disclose a paintball assembly capable of channeling pressurized air or gas via an air line or pipe inside of the paintball assembly using a transfer rod. The assembly includes a main valve, an air pipe, a bolt, a hammer, and a U-shaped rod. While the main valve is configured to propel a paintball utilizing pressurized gas, the air pipe supplies and channels the pressurized gas to the valve. The bolt guides or pushes the paintball into a firing chamber, and the hammer manages or controls the main valve for propelling the paintball upon pulling of the trigger. The U-shaped rod is used to synchronize the movement of the bolt and the hammer. In one embodiment, the U-shaped rod is configured in such a way that at least a portion of the U-shaped rod is structured around the air pipe to reduce contact with the air pipe.

Additional features and benefits of the exemplary embodiment(s) of the present invention will become apparent from the detailed description, figures and claims set forth below.

BRIEF DESCRIPTION OF THE DRAWINGS

Exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Figure 1A:
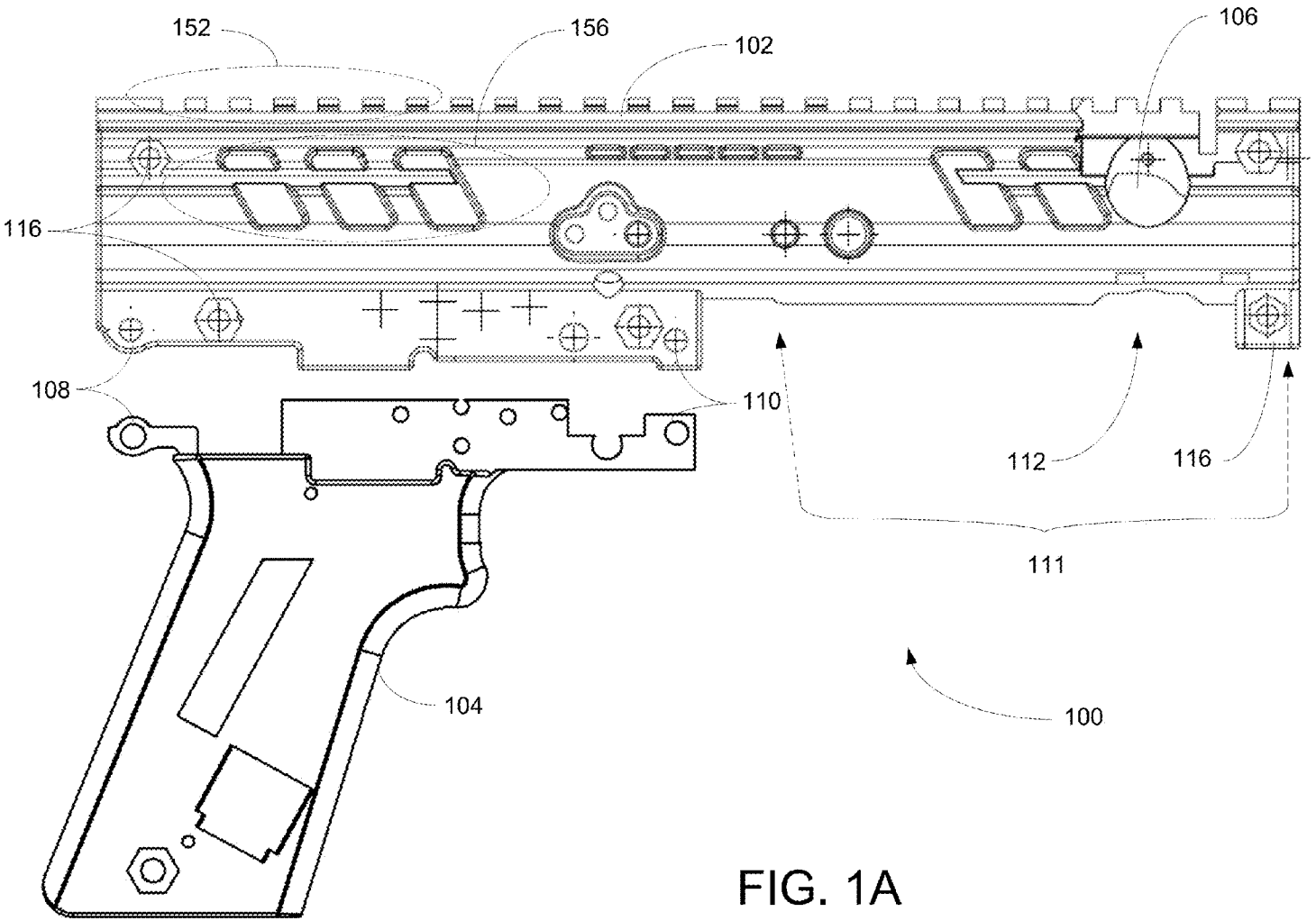
FIGS. 1A-D are diagrams illustrating a right side receiver in accordance with one embodiment of the present invention.

Exemplary embodiment(s) of the present invention is described herein in the context of a method, system and apparatus of retrofitting a paintball propelling device with a receiver capable of facilitating optional paintball feed mechanisms.

Those of ordinary skills in the art will realize that the following detailed description of the exemplary embodiment(s) is illustrative only and is not intended to be in any way limiting. Other embodiments will readily suggest themselves to such skilled persons having the benefit of this disclosure. Reference will now be made in detail to implementations of the exemplary embodiment(s) as illustrated in the accompanying drawings. The same reference indicators will be used throughout the drawings and the following detailed description to refer to the same or like parts.

References to "one embodiment," "an embodiment," "example embodiment," "various embodiments," "exemplary embodiment," "one aspect," "an aspect," "exemplary aspect," "various aspects," etc., indicate that the embodiment(s) of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

In the interest of clarity, not all of the routine features of the implementations described herein are shown and described. It will, of course, be understood that in the development of any such actual implementation, numerous implementation-specific decisions may be made in order to achieve the developer's specific goals, such as compliance with application- and business-related constraints, and that these specific goals will vary from one implementation to another and from one developer to another. Moreover, it will be understood that such a development effort might be complex and time-consuming, but would nevertheless be a routine undertaking of engineering for those of ordinary skills in the art having the benefit of this disclosure.

Various embodiments of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

As used herein, the singular forms of article "a", "an" and "the" are intended to include the plural forms as well, unless the context clearly indicates otherwise. Also, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

Overview for Retrofit Kit

Embodiments of the present invention disclose a retrofit kit providing flexible paintball loading mechanism for a paintball gun. In one embodiment, the retrofit kit includes a right side portion of a receiver, a left side portion of the receiver, and a bottom removable adapter. The right side portion of a receiver having a first feed hatch is able to receive paintballs through an upper loading mechanism. The left side portion of the receiver, after coupling with the right side portion of the receiver to form a receiver, is capable of coupling to a barrel as well as a pressured gas container. The bottom removable adapter, in one embodiment, facilitates to receive paintballs via a bottom feeding mechanism. In one example, the kit further includes a right grip portion capable of coupling to the right side portion of the receiver and a left grip portion capable of coupling to the left side portion of the receiver for gripping.

FIG. 1A is a diagram 100 illustrating a right side receiver in accordance with one embodiment of the present invention. Diagram 100 includes a right side receiver 102 and a right side portion of a grip 104. Receiver, assembly, body, or frame 102 of a paintball marker or gun is part of physical structure that houses various mechanical and/or operating parts or components. The terms "receiver," "body," "assembly," and "frame" are hereinafter used interchangeably. Right side receiver 102, in one aspect, can be fabricated or casted with solid or rigid materials which can stand a range of predefined stresses as well as temperature variations. The materials include, but not limited to, metal, aluminum, polymers, alloy, composite plastics, and the like. It should be noted that the underlying concept of the exemplary embodiment(s) of the present invention would not change if one or more components (or elements) were added to or removed from diagram 100.

Right side receiver 102, in one embodiment, includes an opening 106 for top loading or top feed paintballs and a cut-out area 111 configured to couple to a bottom feed adapter. Opening 106, in one aspect, can be selectively closed by a hatch, a cover, or a door when the top feed mechanism of paintballs is not used. Paintballs are considered as ammunition for the paintball gun or marker and they, for example, are round or spherical shaped capsules containing dye substances. Upon an impact of a paintball, the paintball leaves a colored marker. The bottom feed adapter, which is not shown in FIG. 1A and will be discussed more detail later, includes a bottom feed port 112 which facilitates bottom feed mechanism of paintballs. Right side receiver 102 further includes various holes 116 for fastening purposes.

Grip or handle 104, in one embodiment, is an optional component facilitating gripping and/or handling. Depending on the applications, grip 104 may or may not be mounted. Applications may vary depending on which existing paintball marker is to be retrofitted. When grip 104 is desirable, grip 104 can be mounted onto right side receiver 102 using mounting holes 108-110. It should be noted that fasteners such as screws and bolts can be used to secure grip 104 onto right side receiver 102 via holes 108-110. Grip 104 is fabricated or casted with solid or rigid materials capable of facilitating handling comfort. The solid or rigid materials include wood, rubber, metal, aluminum, polymers, alloy, composite plastics, and the like.

It should be noted that various other features such as knock-outs 156 and grooves 152 are relating to aesthetic and/or other functional valves whereby they do not alter the underlying concept of the exemplary embodiment(s) of the present invention if the shape of knock-outs or a groove changes.

Figure 1B:
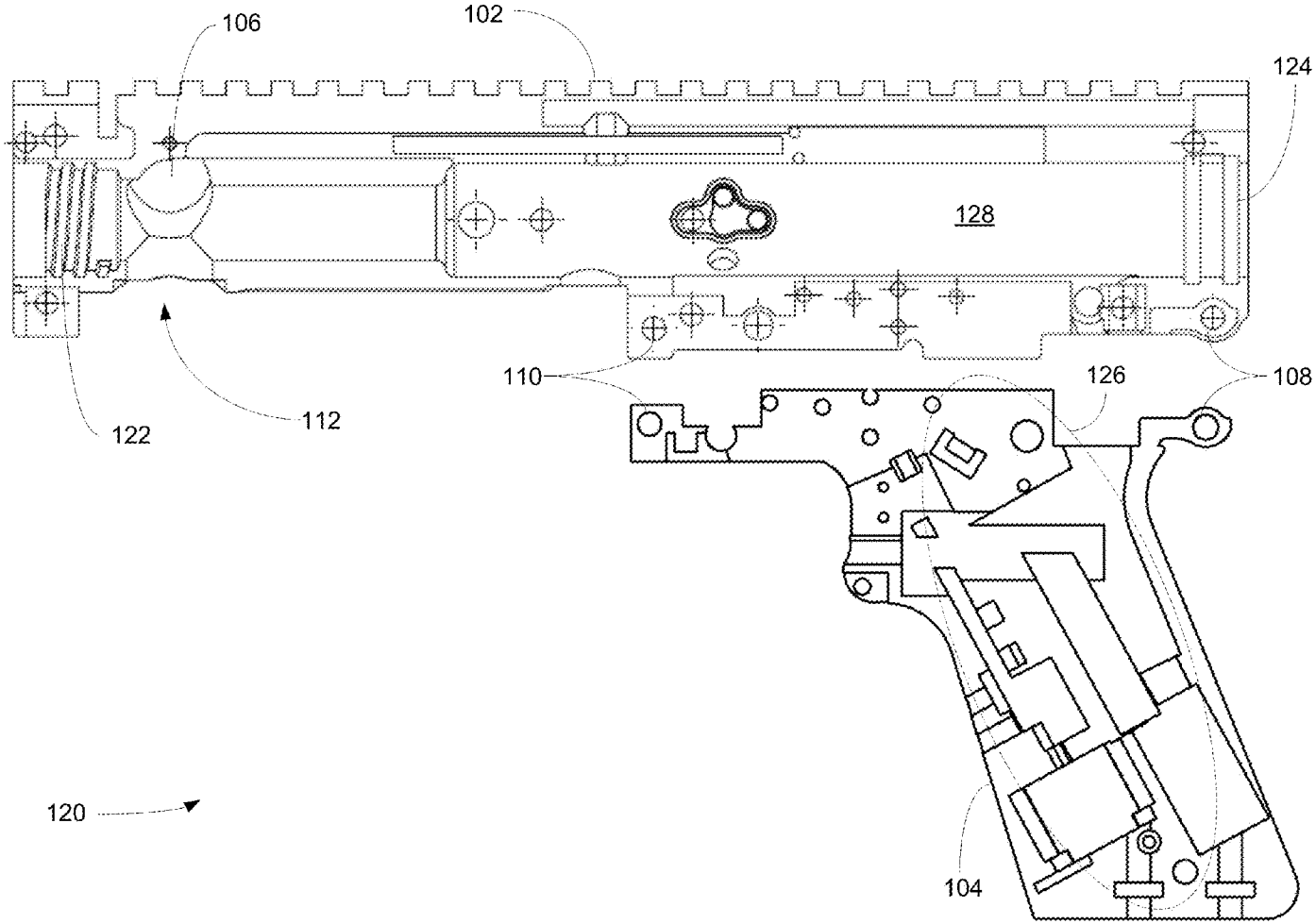

FIG. 1B is a diagram 120 illustrating a right side internal view of a receiver in accordance with one embodiment of the present invention. Diagram 120 includes a right side internal view of a receiver 102 and a right side portion internal view of a grip 104. The right side internal view of receiver 102 includes a barrel coupling system 122, a recess 128, and a rear coupling system 124. Barrel coupling system 122, in one example, includes a coupling device as such threads configured to couple with a barrel. Recess 128 is used to house a propelling mechanism while rear coupling system 124 may be used to couple an end cap, a buttstock, or a compressed air tank. Right side portion internal view of a grip 104, in one embodiment, includes various mechanical or circuitry elements 126 such as battery. It should be noted that the underlying concept of the exemplary embodiment(s) of the present invention would not change if one or more components (or elements) were added to or removed from diagram 120.

Figure 1C:
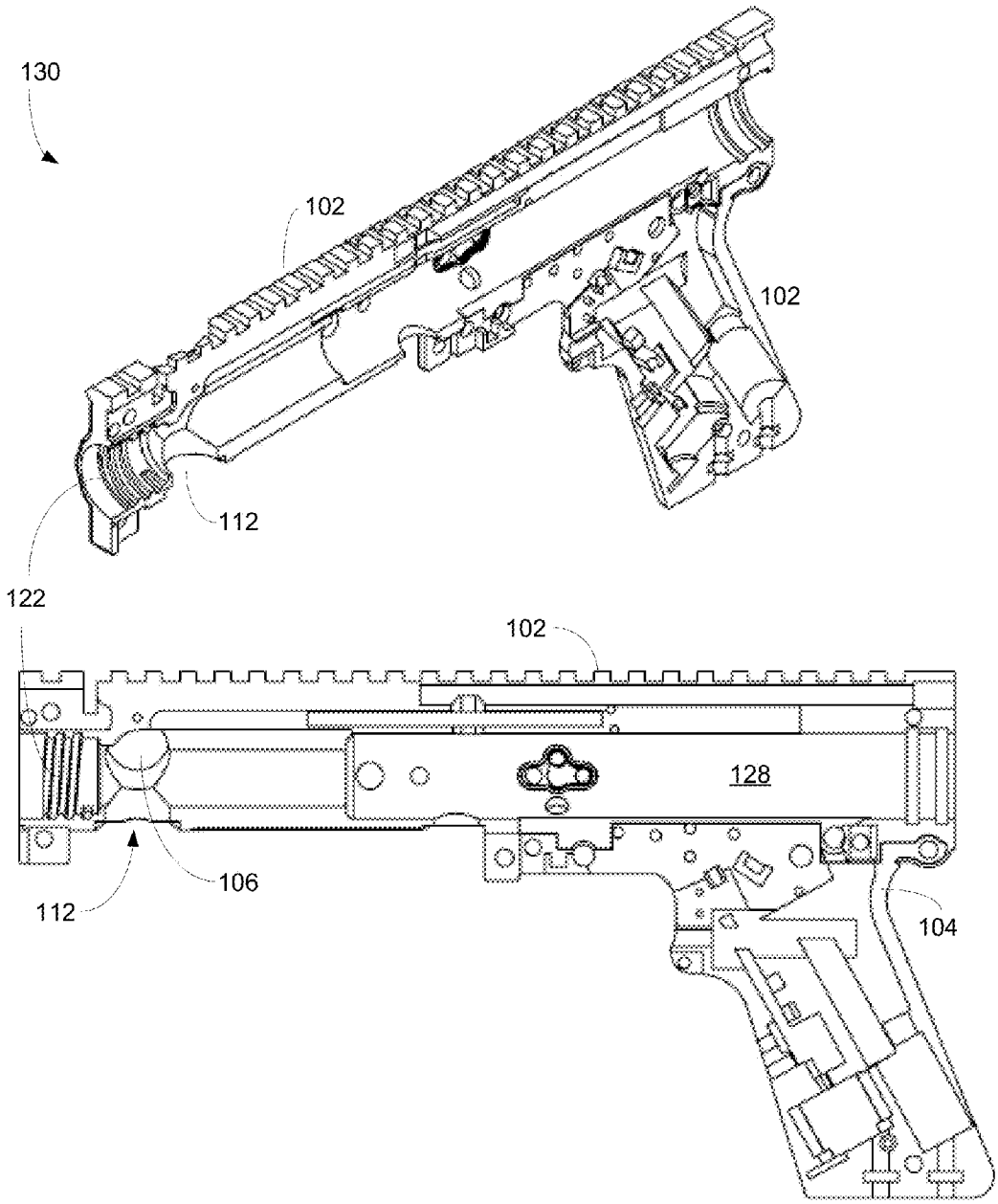

FIG. 1C is a diagram 130 illustrating a right side internal view of a receiver in accordance with one embodiment of the present invention. Diagram 130 illustrates right side receiver 102 mounted with grip 104. The right side internal view of receiver 102 includes a barrel coupling system 122, a recess 128, and a rear coupling system 124.

Figure 1D:
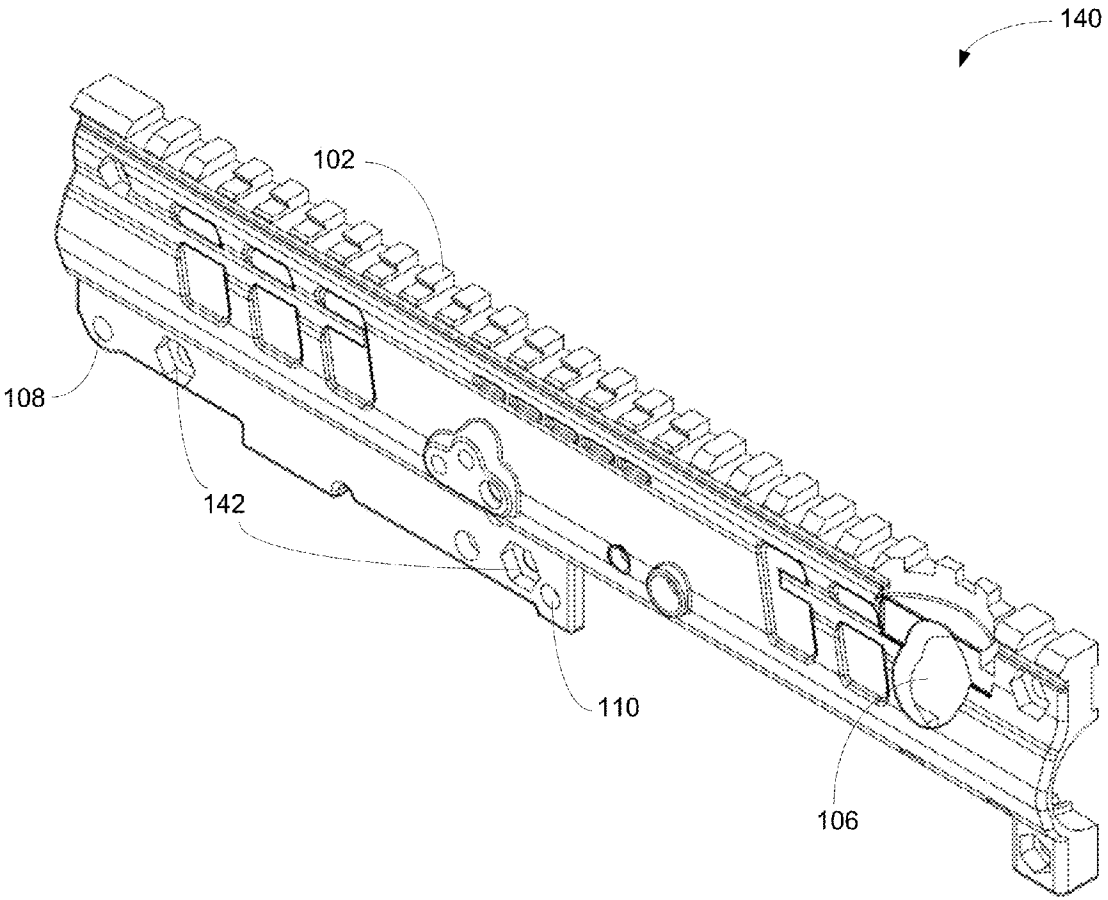

FIG. 1D illustrates a three dimensional ("3D") diagram 140 showing a right side receiver in accordance with one embodiment of the present invention. Diagram 140 illustrates right side receiver 102 without a grip mounted. It should be noted that the underlying concept of the exemplary embodiment(s) of the present invention would not change if one or more components (or elements) were added to or removed from diagram 140.

Figure 2A:
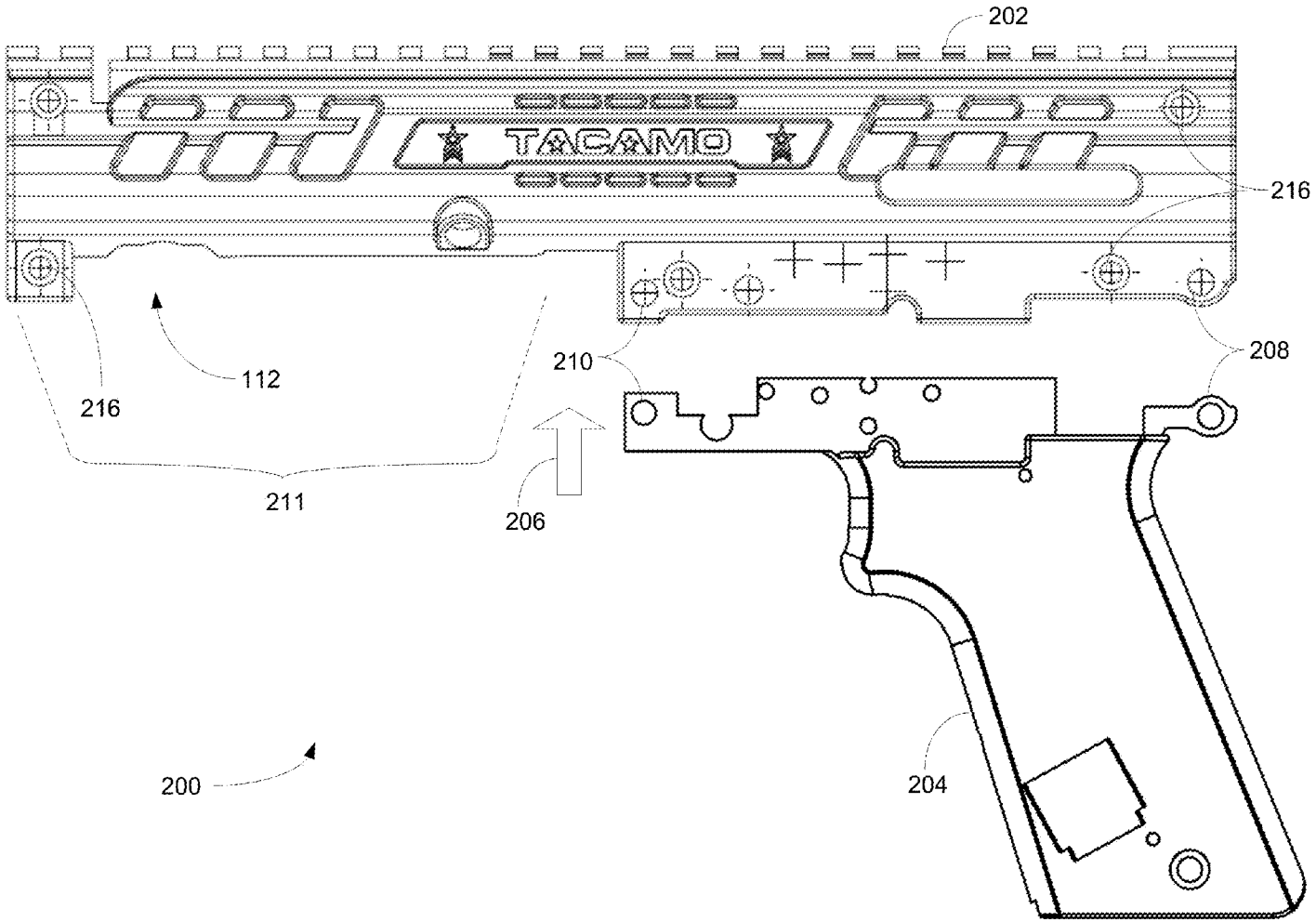
FIGS. 2A-B are diagrams illustrating a left side receiver in accordance with one embodiment of the present invention.

FIG. 2A is a diagram 200 illustrating a left side receiver in accordance with one embodiment of the present invention. Diagram 200 includes a left side receiver 202 and a left side portion of a grip 204. Similar to right side of a right side receiver 102, left side receiver 202 is fabricated or casted with solid or rigid materials which can withhold a range of predefined pressure stress as well as temperature variations. The materials include, but not limited to, metal, aluminum, polymers, alloy, composite plastics, and the like. It should be noted that the underlying concept of the exemplary embodiment(s) of the present invention would not change if one or more components (or elements) were added to or removed from diagram 200.

Left side receiver 202, in one embodiment, includes a cut-out area 211 configured to couple to a bottom feed adapter. The bottom feed adapter, not shown, couples to both right side receiver 102 and left side receiver 202. The adapter, which will be discussed more detail later, includes a bottom feed port 112 capable of facilitating bottom feed mechanism of paintballs. Left side receiver 202 further includes various holes 216 for fastening purposes.

Left side portion of grip 204, in one embodiment, is an optional component facilitating hand gripping and/or handling. Depending on the applications, grip 204 may or may not be mounted onto left side receiver 202. When left side portion of grip 204 is desirable, left side portion of grip 204 can be mounted onto left side receiver 202 using mounting holes 208-210. It should be noted that fasteners such as screws and bolts may be used to secure grip 104 onto left side receiver 202 via holes 208-210. Left side portion of grip 204 can be fabricated or casted with solid or rigid materials capable of facilitating hand holding or griping. The solid or rigid materials include wood, rubber, metal, aluminum, polymers, alloy, composite plastics, and the like.

Figure 2B:
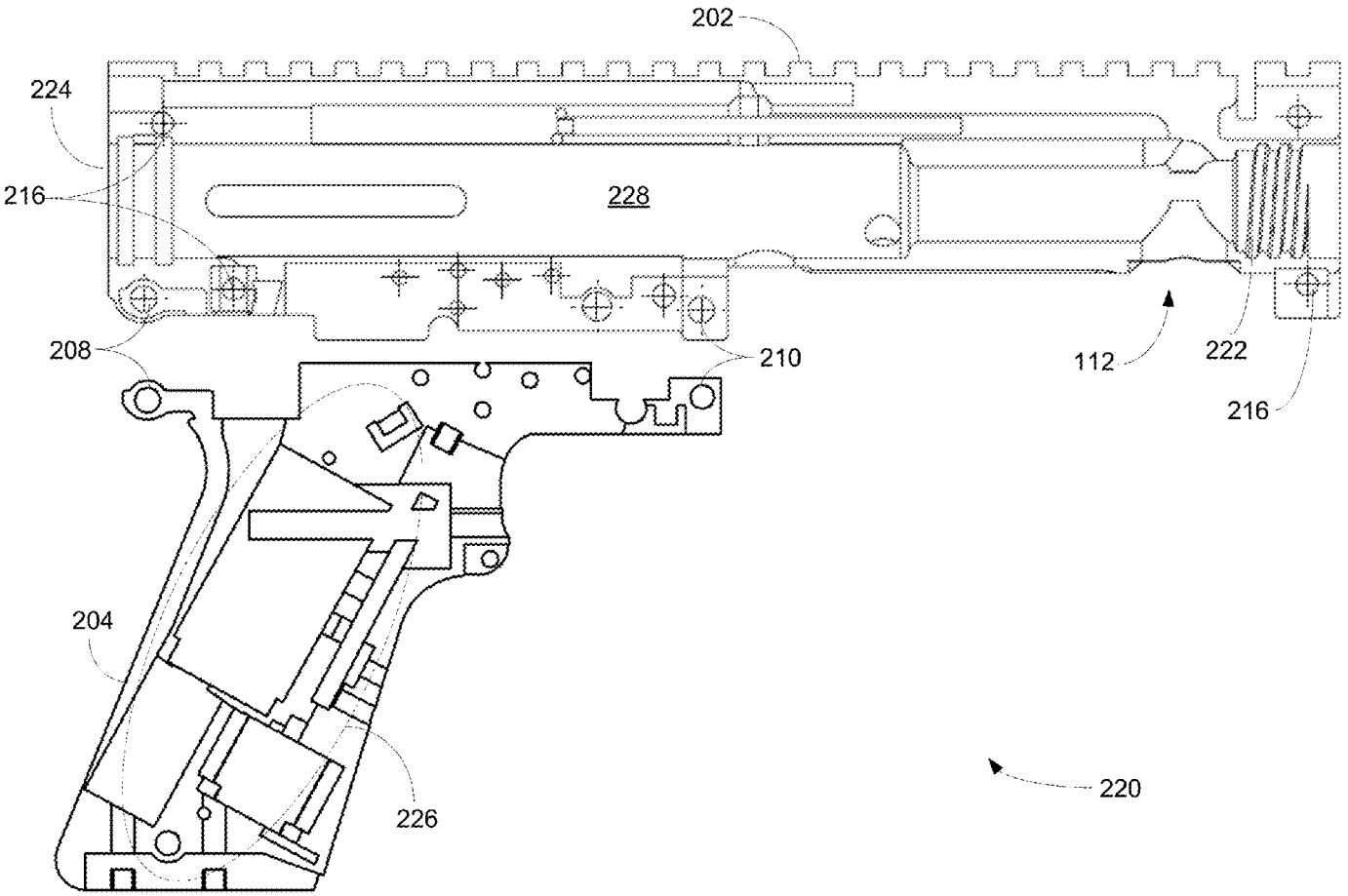

FIG. 2B is a diagram 220 illustrating a left side internal view of a receiver in accordance with one embodiment of the present invention. Diagram 220 includes a left side internal view of a receiver 202 and a left side portion internal view of a grip 204. Left side internal view of receiver 202 includes a barrel coupling system 222, a recess 228, and a rear coupling system 224. Barrel coupling system 222, in one example, includes a coupling device as such threads configured to couple with a barrel. Recess 228 is used together with recess 128 to house a propelling mechanism while rear coupling system 224 may be used to couple an end cap, a buttstock, or a compressed air tank. Light side portion internal view of a grip 204, in one embodiment, includes various mechanical or circuitry elements 226.

Figure 3A:
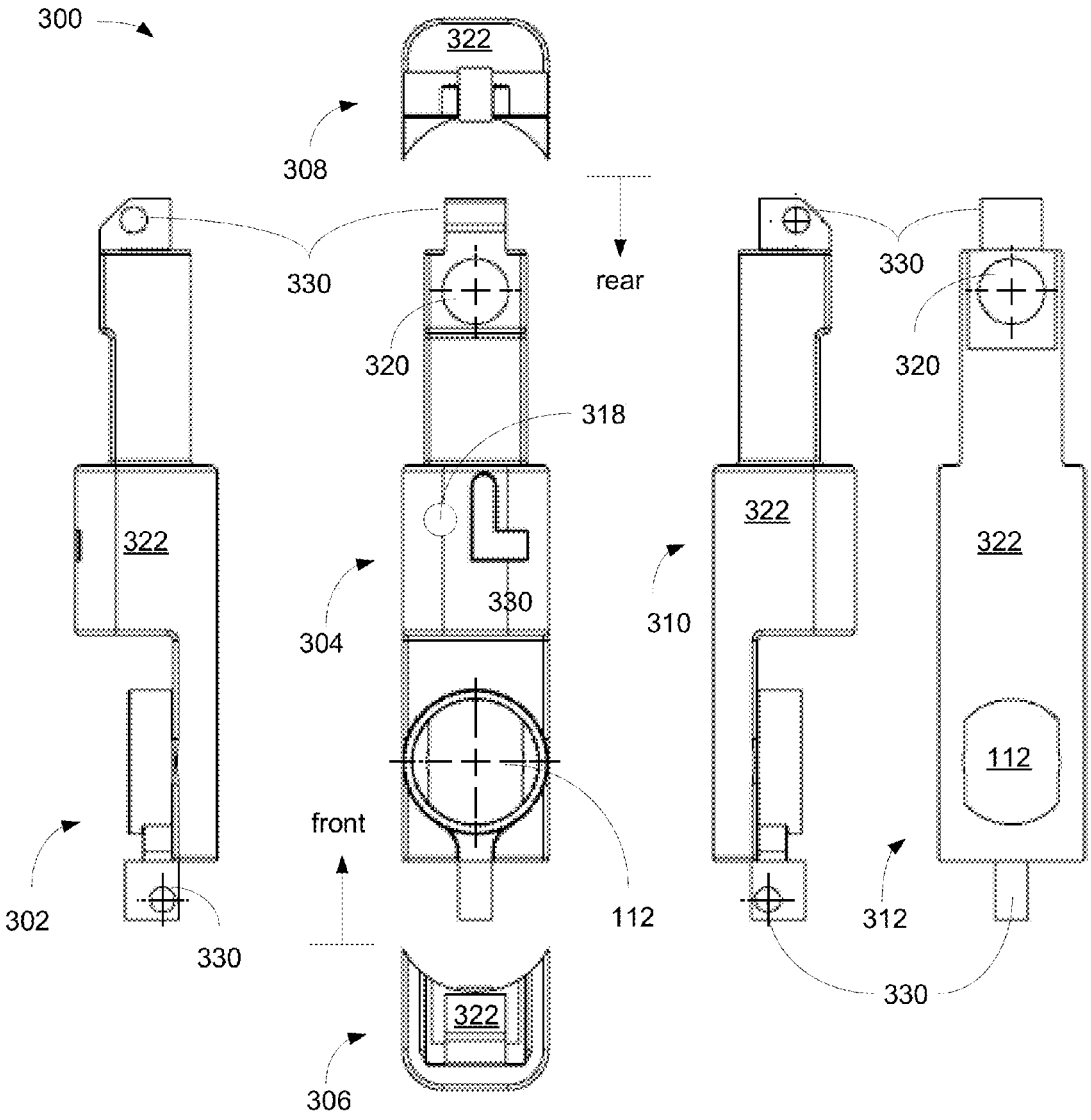
FIGS. 3A-B are diagrams illustrating a bottom feed adapter in accordance with one embodiment of the present invention.

FIG. 3A is a set of diagrams 300 illustrating various views of bottom feed adapter in accordance with one embodiment of the present invention. FIG. 3A illustrates a left view 302 of bottom feed adapter 322, top view 304 of bottom feed adapter 322, right view 310 of bottom feed adapter 322, bottom view 312 of bottom feed adapter 322, front view 306 of bottom feed adapter 322, and rear view 308 of bottom feed adapter 322. Bottom feed adapter 322, in one embodiment, includes a bottom feed port 112, a gas port 320, and an optical lighting device 318. It should be noted that the underlying concept of the exemplary embodiment(s) of the present invention would not change if one or more components (or elements) were added to or removed from diagram 300.

Bottom feed port 112, in one embodiment, is an opening having a predefined dimension that allows conventional paintballs to pass through. When bottom feed adapter 322 is coupled to a bottom feed magazine (not shown in FIG. 3A), the bottom feed magazine, which is powered by a bottom feed mechanism, generates a force which is in a direction opposite from the gravitation force to push a paintball from the magazine into a receiver of paintball gun through bottom feed port 112. After the paintball in the receiver is fired or released, optical lighting device 318 emits an optical signal or light instructing the magazine to feed another paintball to the receiver through bottom feed port 112.

Figure 3B:
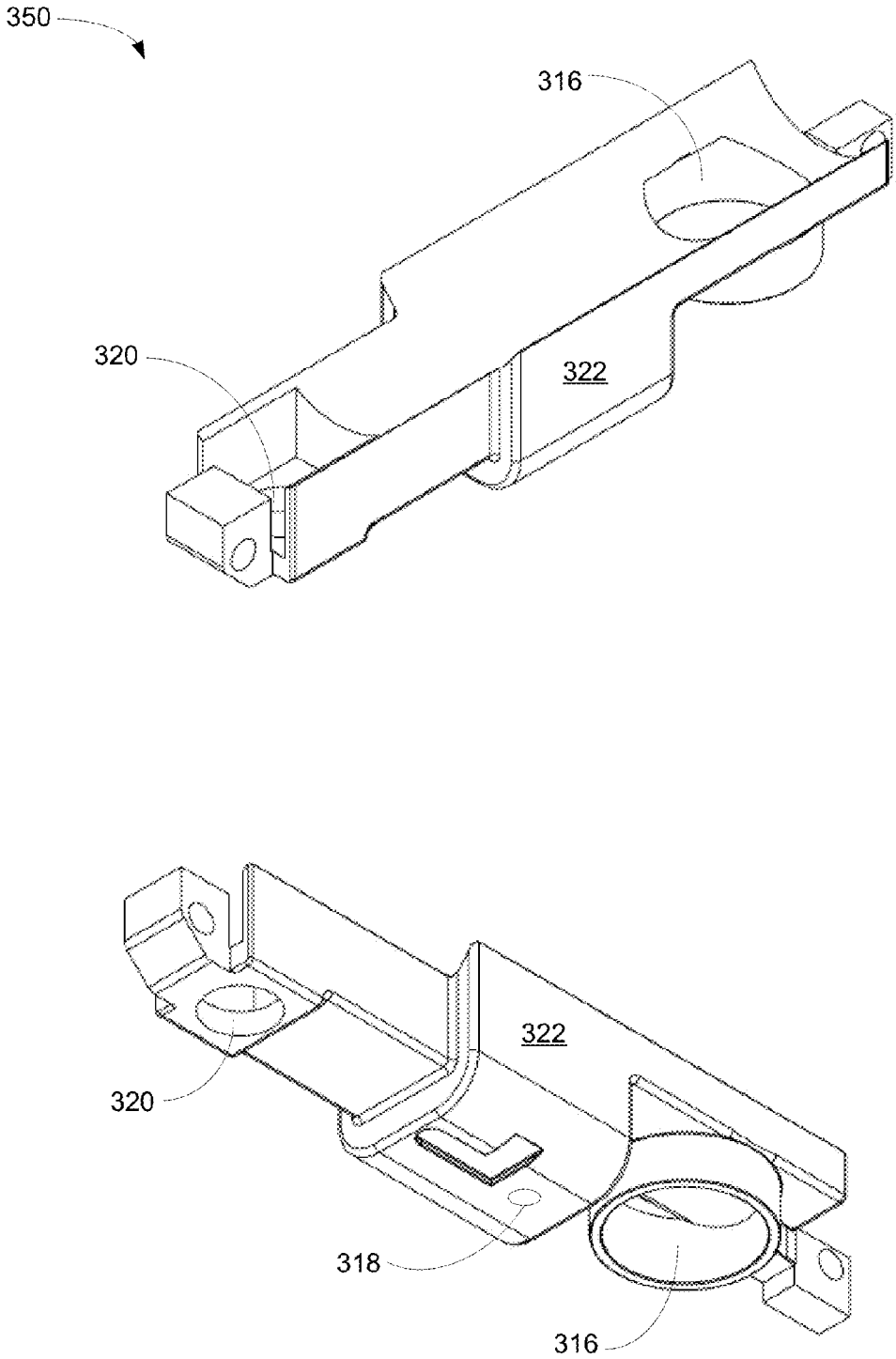

Bottom feed adapter 322, in one embodiment, is coupled to left and right sides of receiver to form a complete receiver that is capable of retrofitting an existing paintball marker or gun. Various attaching elements 330 are used to fasten bottom feed adapter 322 to left and right side receiver. It should be noted that the dimension of bottom feed adapter may vary depending on the applications. FIG. 3B illustrates three dimensional drawings of bottom feed adapter with different viewing angles in accordance with one embodiment of the present invention. Note that depending on the applications, the shape and design of bottom feed adapter may vary slightly.

Figure 4:
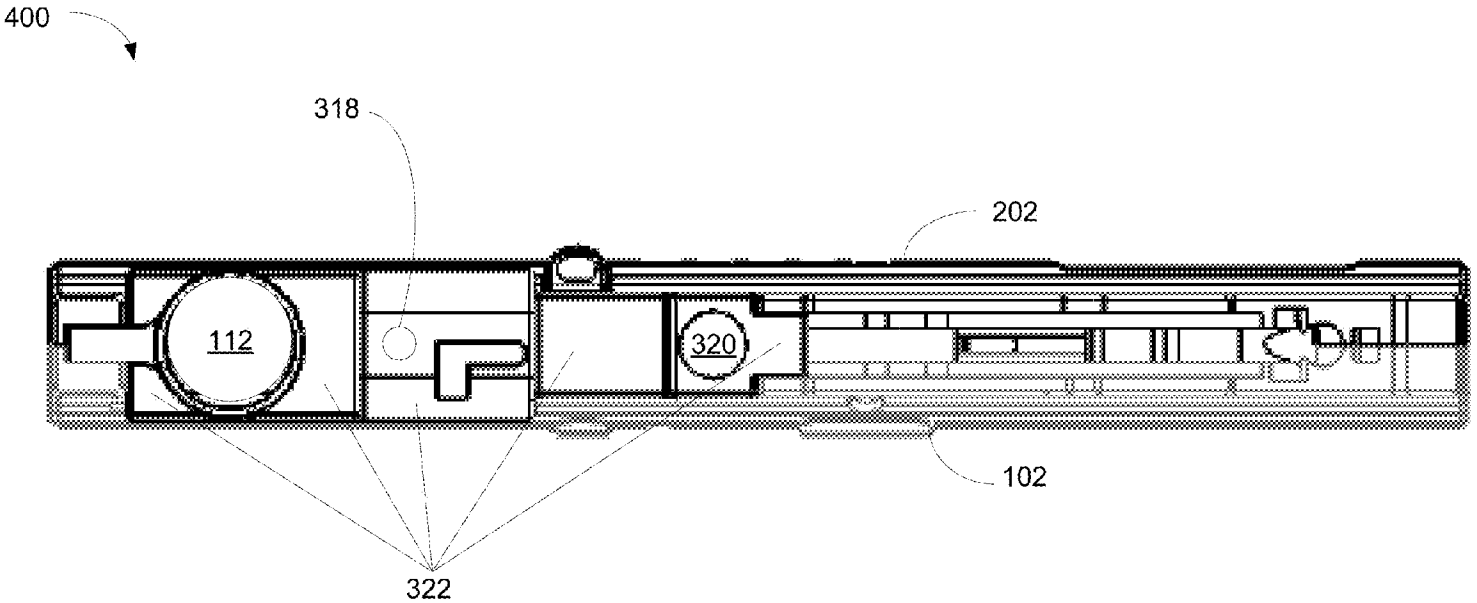
FIG. 4 is a diagram illustrating a bottom view of a receiver including a bottom feed adapter in accordance with one embodiment of the present invention.

FIG. 4 is a diagram 400 illustrating a bottom view of a receiver capable of facilitating bottom feed mechanism in accordance with one embodiment of the present invention. Diagram 400 shows a bottom view of a receiver including right side receiver 102, left side receiver 202, and a bottom feed adapter 322. While bottom feed port 112 facilitates paintball passage from bottom feed magazine to the receiver, gas port 320 coupled to a gas line receiving pressurized gas from a compressed air or nitrogen tank, not shown in FIG. 4.

Figure 5A:
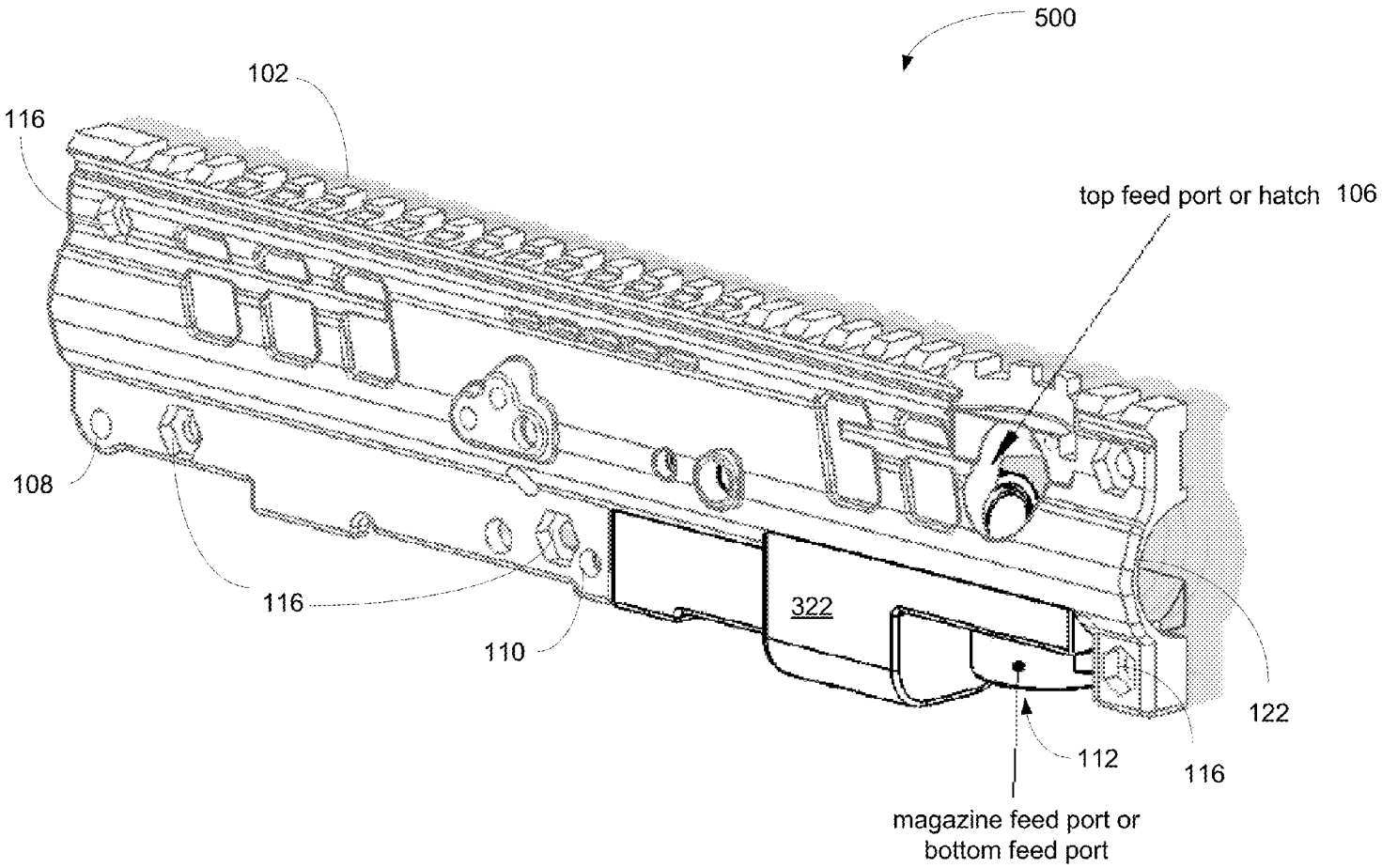
FIGS. 5A-E are diagrams illustrating perspective view of a receiver having a bottom feed adapter mounted to the receiver in accordance with one embodiment of the present invention.

FIG. 5A is a 3D diagram 500 illustrating a perspective view of a receiver in accordance with one embodiment of the present invention. Diagram 500, in one aspect, illustrates a right side receiver 102 having bottom feed adapter 322 capable of accepting paintballs fed from the bottom feed magazine, not shown. Holes 116 are used to fasten with the left side receiver, not shown, to form a complete receiver. Right side receiver 102 also includes a top feed port or hatch 106 capable of accepting paintballs fed from a container or hopper situated above right side receiver 102. It should be noted that the underlying concept of the exemplary embodiment(s) of the present invention would not change if one or more components (or elements) were added to or removed from diagram 500.

Figure 5B:
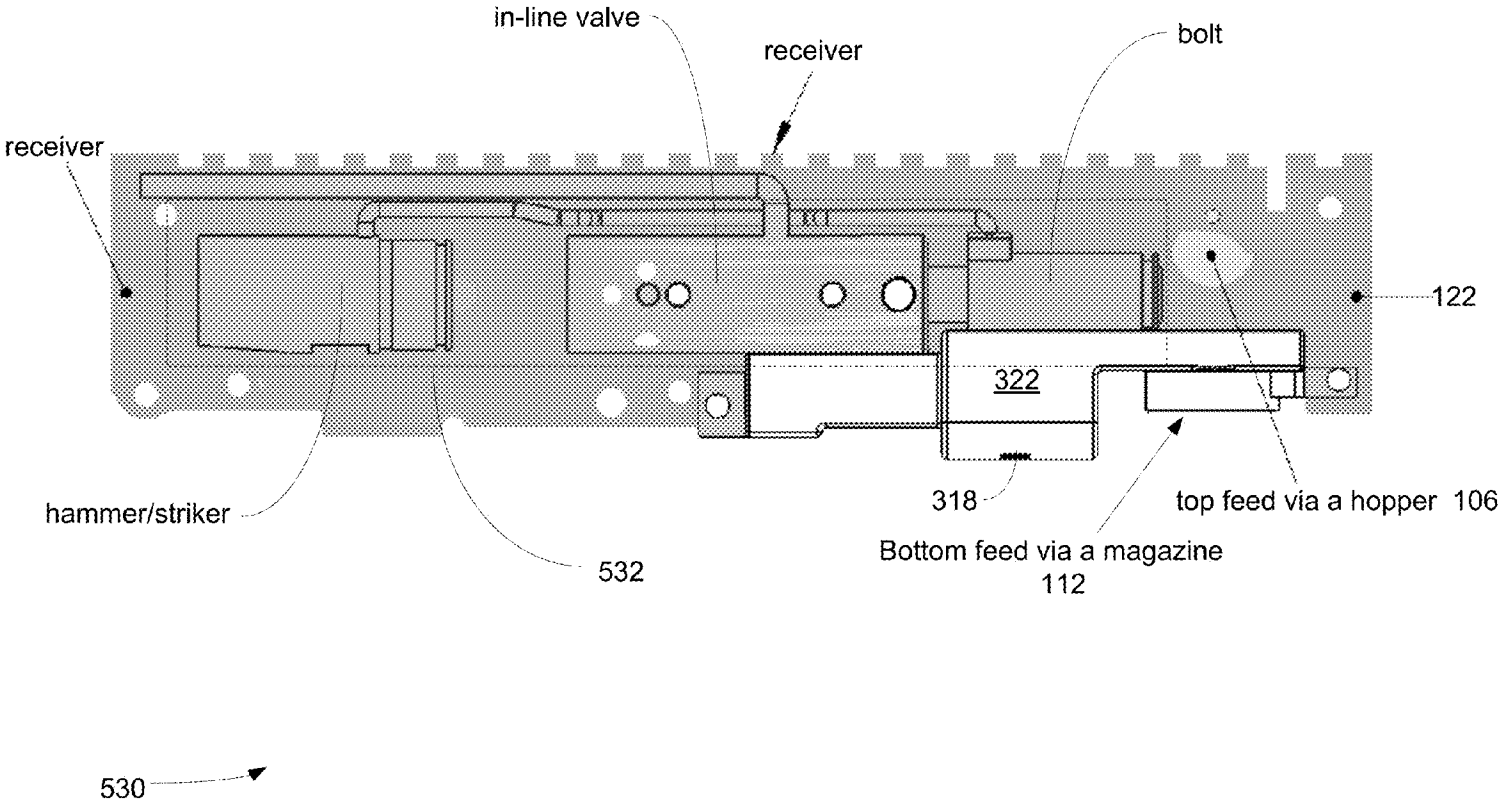
Figure 5C:
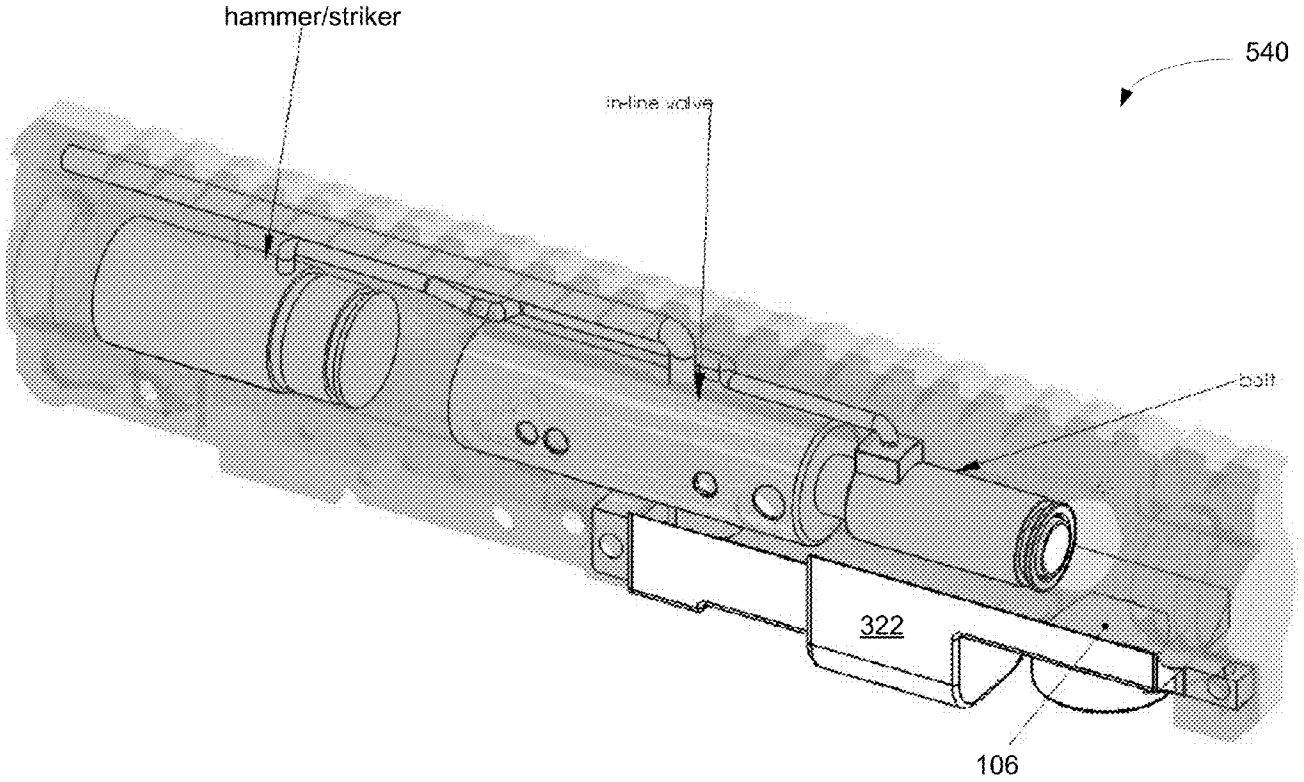

FIG. 5B illustrates an internal perspective view of a receiver and FIG. 5C illustrates a 3D internal perspective view of a receiver 540 in accordance with one embodiment of the present invention. Diagram 500 includes a projectile propelling system 532 and a bottom feed adapter 322 mounted to the receiver. In one embodiment, the receiver is capable of accept top feed mechanism via opening 106. Alternatively, the receiver can select bottom feed mechanism via bottom feed port 112. Depending on the applications, a paintball operator can selectively choose between top and bottom feed mechanisms. Note that both top and bottom feed mechanisms are able to deliver a paintball in the chamber of receiver when it is empty.

Projectile propelling system 532 includes hammer or striker, in-line valve, and a bolt. In one embodiment, various traditional projectile propelling systems may be retrofitted with embodiments of the present disclosed retrofit kit whereby the retrofitted paintball guns are able to accept loading from the bottom feed as well as the top feed. When an operator pulls the trigger of a paintball marker, the pressure unlatches the hammer from the bolt and the projectile (i.e., paintball) is propelled.

Figure 5D:
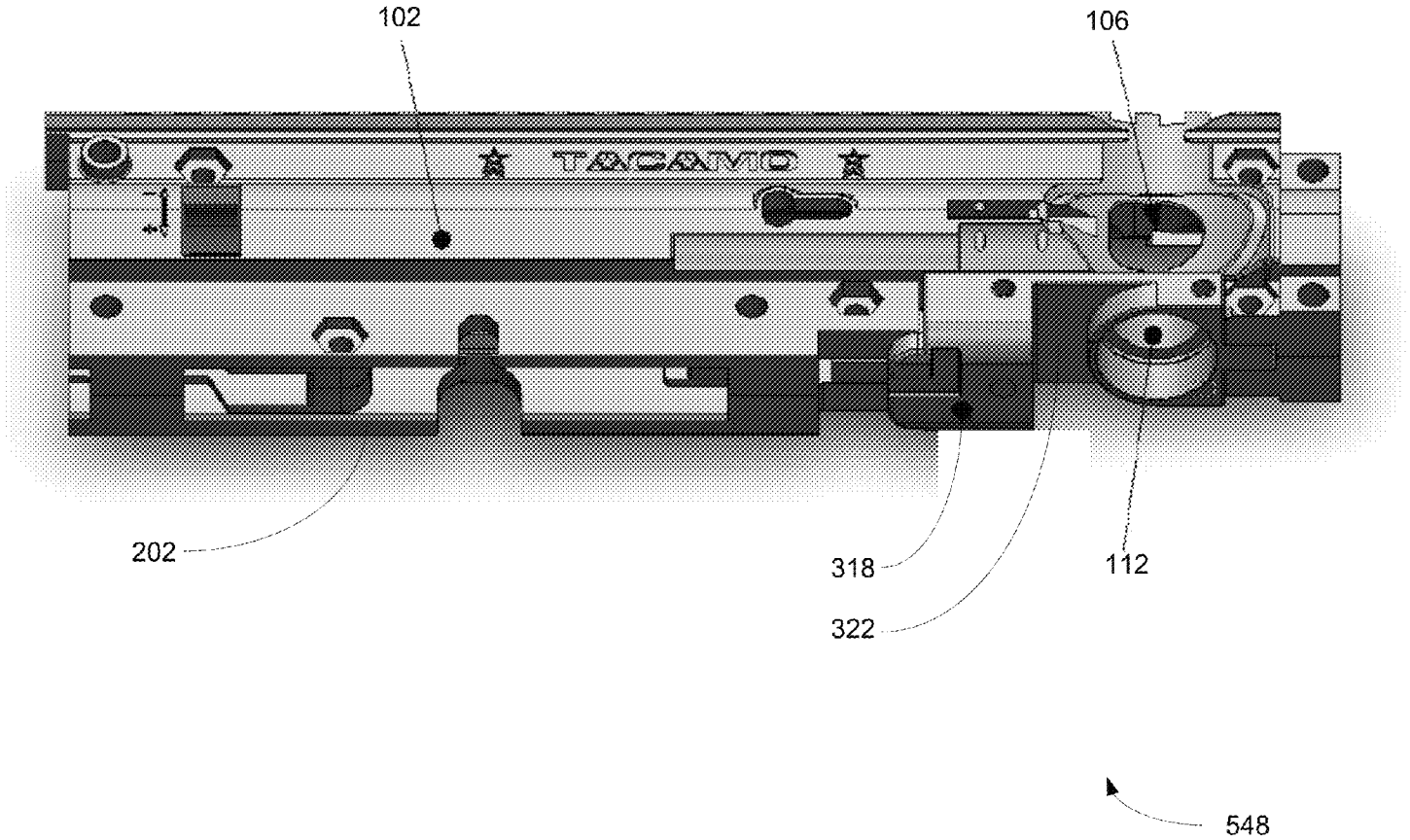
Figure 5E:
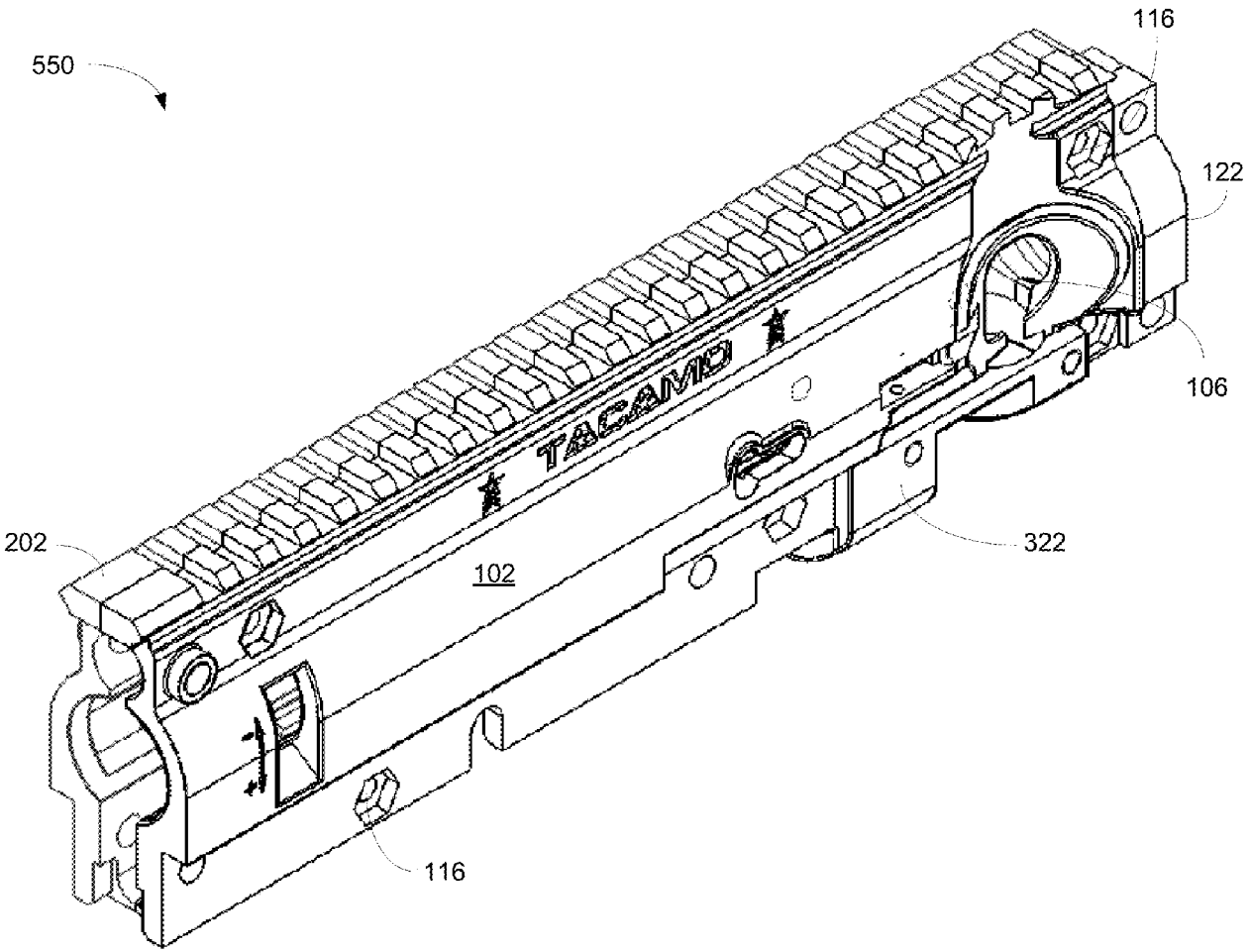

FIGS. 5D-E are 3D diagrams illustrating alternative configurations of a retrofit kit or receiver in accordance with one embodiment of the present invention. Diagrams 548-550 shows retrofit receivers with slightly different dimensions which will be able to retrofit with various different traditional paintball markers. Note that receivers shown in diagram 548-550 include bottom feed adapter 322 which facilitates to receive paintballs from the bottom feed mechanism via bottom feed port 112. Alternatively, receivers illustrated in diagram 548-550 are also able to receive paintballs from the top feed mechanism via top feed port 106.

Figure 6:
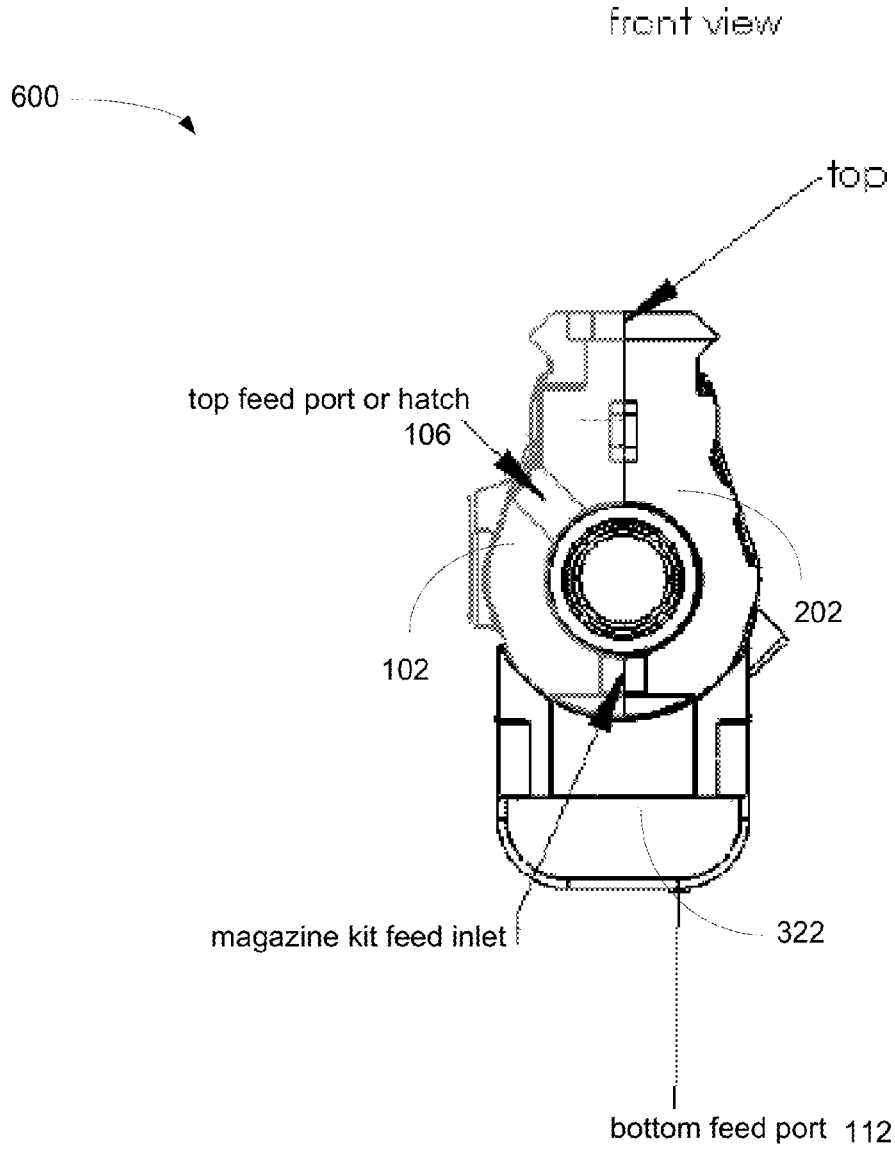
FIG. 6 is a diagram illustrating a front view a receiver showing a top feed port and a bottom feed adapter in accordance with one embodiment of the present invention.

FIG. 6 is a diagram 600 illustrating a front view a receiver showing a top feed port 106 and a bottom feed adapter 322 in accordance with one embodiment of the present invention. The receiver includes a right side receiver 102, a left side receiver 202, and a bottom feed adapter 322. In one embodiment, the receiver also shows a top feed hatch 106 and a bottom feed port 112. When the bottom feed mechanism is not elected, an alternative bottom adapter, which may include in a kit, may be used to seal the bottom feed port or opening.

An advantage of employing the disclosed embodiments of retrofit kit is to allow a paintball operator to pick and choose whether the paintballs should be fed from top, bottom, or both. For example, embodiments of the present invention allow existing paintball guns to be retrofitted to accept a bottom feed paintball mechanism. The existing paintball guns may include, but not limited to, Tippmann 98™, Tippmann A5™, Tippmann X7™ Tippmann X7 Phenom™, BT Combat™, BT Delta™, BT SWAT™, BT4™, US Army Alpha Black™, US Army Project Salvo™, US Army Carver One™, and Valken SW-1™.

In one embodiment, a retrofit assembly for a paintball propelling device includes a first solid side, a second solid side, and a third removable solid side. The first solid side includes a first feed hatch configured to receive paintballs through a first feeding mechanism. The retrofit assembly, in one embodiment, further includes a first grip portion couple to the first solid side for gripping. The first solid side is a right side portion of a receiver capable of catapulting a paintball in response to a launching mechanism. The first feed hatch is operable to couple to a feeder elbow capable of receiving paintballs fed by gravitational force. The feeder elbow, for example, is able to couple with a hopper capable of containing multiple paintballs. The hopper is generally situated in such a way that paintballs can be fed to the chamber of receiver via gravity.

The second solid side is coupled to the first solid side to form a receiver which is further configured to couple with a barrel. The retrofit assembly may further include a second grip couple to the second solid side for gripping. The second solid side is a left side portion of the receiver capable of catapulting a paintball in response to a launching mechanism. The first and second solid sides can be fabricated by aluminum, zinc, alloy, composite materials, or pressure resistance plastics. The first feeding mechanism includes a hopper situated approximately above the receiver and feeds paintballs to the receiver with a gravitational force. The second feeding mechanism includes a magazine situated approximately below the receiver and pushes paintballs in a direction opposite of gravity to the receiver for launching.

The third removable solid side coupled to the receiver and capable of facilitating to receive paintballs via a second feeding mechanism. The assembly of claim 1, wherein a third removable solid side is a bottom feed adapter, wherein the bottom feed adapter is able to couple to a bottom feed magazine. The third removable solid side can also be made by aluminum, zinc, alloy, composite materials, and/or pressure resistance plastics. In one aspect, the bottom feed magazine generates a loading force to push a paintball in a direction against gravity into the receiver for launching the paintball. The third removable solid side includes an optical light emitting component capable of providing a light signal(s) in accordance with firing a paintball from the receiver.

It should be noted that the exemplary embodiments of the present invention disclose a retrofit kit having a receiver capable of facilitating top and bottom feed systems. The receiver can be formed by three (3) separate components, namely a right side receiver 102, a left side receiver 202, and a bottom feed adapter 322 as illustrated above. The receiver, however, does not have to be formed by three (3) components. For example, depending on the applications, the receiver may be formed by one (1) or two (2) components. In an exemplary embodiment, a receiver may be formed by two (2) components, such as a top half receiver and a bottom half receiver wherein the bottom half receiver containing a bottom feed port. Alternatively, a receiver having a top feed hatch and a bottom feed port may be manufactured with one (1) single fabrication process. It should be further noted that the receiver for retrofitting can also be formed with more than three (3) components.

The retrofit assembly further includes a feed switch coupled to the receiver and configured to selectively switch between the first feeding mechanism and the second feeding mechanism. In addition, the receiver is able to couple to a compressed air tank used to propel a paintball into a trajectory.

An advantage of using the embodiments of the present invention is to allow an operator to have a clear line of fire without obstruction such as a hopper.

Figure 7:
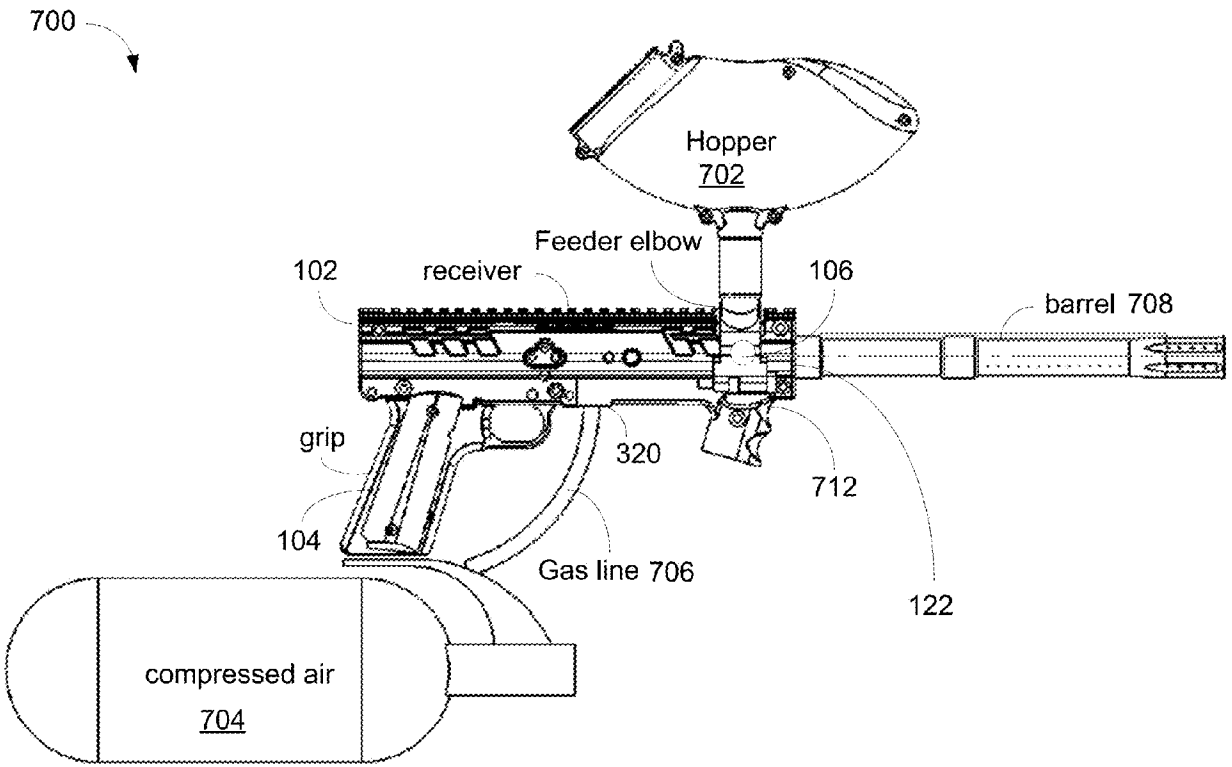
FIG. 7 is a diagram showing a portion of paintball marker being retrofitted with a receiver mounted with a bottom feed adapter in accordance with one embodiment of the present invention.

FIG. 7 is a diagram 700 showing a portion of paintball marker being retrofitted with a receiver mounted with a bottom feed adapter in accordance with one embodiment of the present invention. Diagram 700 includes a receiver, a feeder elbow, a hopper 702, a compressed air container 704, a barrel 708, and a gas line 706. The receiver further includes a right side receiver 102, a right side grip portion 104 wherein the receiver is able to couple to hopper 702 using the feeder elbow via top feed hatch 106. In this embodiment, an alternative bottom adapter 712 is used to block the bottom feed mechanism. Alternative bottom adapter 712 can be optionally replace with a bottom feed adapter if the operator elects to use the bottom feed mechanism. It should be noted that the underlying concept of the exemplary embodiment(s) of the present invention would not change if one or more components (or elements) were added to or removed from diagram 700.

Figure 8:
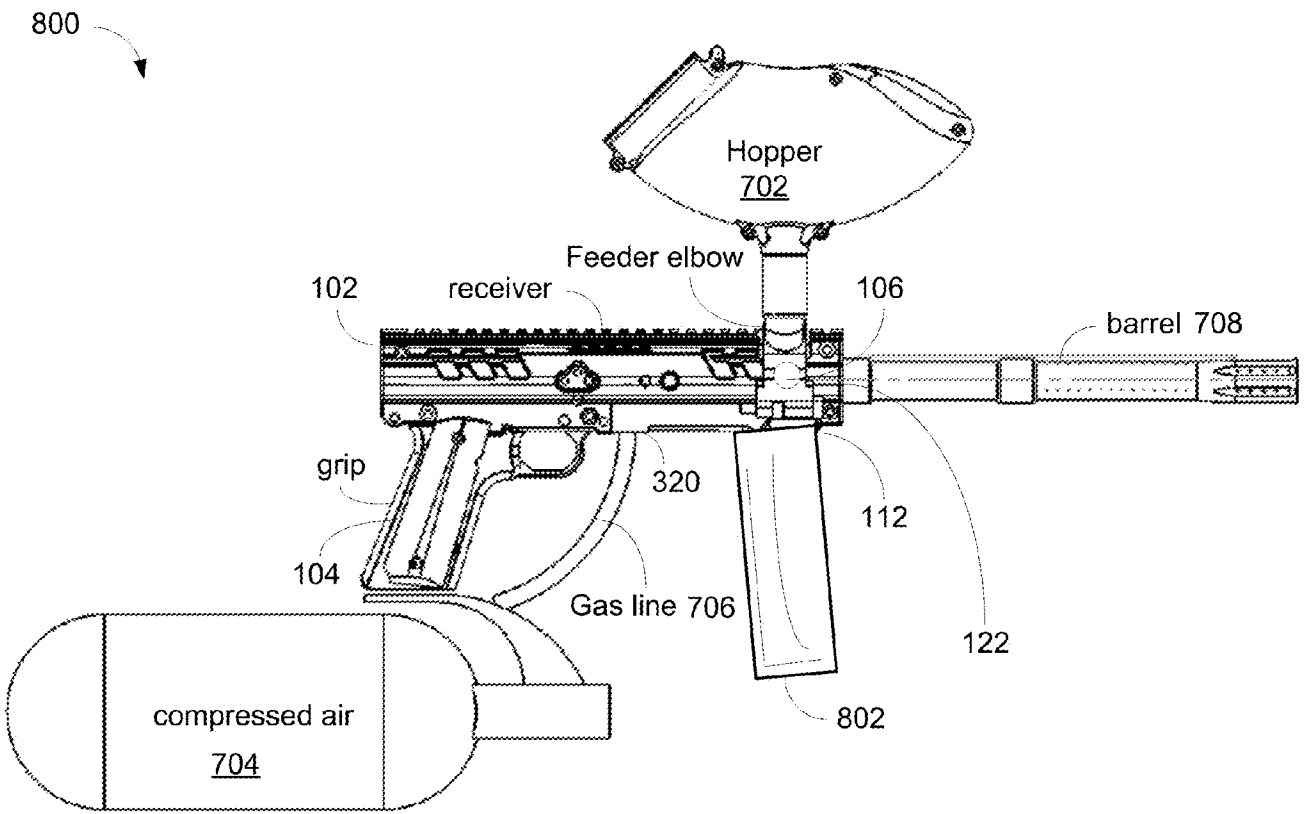
FIG. 8 is a diagram showing a portion of paintball marker being retrofitted with a receiver capable of providing optional loading mechanisms in accordance with one embodiment of the present invention.

FIG. 8 is a diagram 800 showing a portion of paintball marker being retrofitted with a receiver capable of providing optional loading mechanisms in accordance with one embodiment of the present invention. Diagram 800 includes a receiver, a feeder elbow, a hopper 702, a compressed air container 704, a barrel 708, a gas line 706, and a bottom feed magazine 802. A paintball marker operator elects to use both top feed mechanism and bottom feed mechanism. In one embodiment, bottom feed magazine 802 couples to a bottom feed adapter and feeds paintballs to the chamber of receiver via bottom feed port 112. It should be noted that the underlying concept of the exemplary embodiment(s) of the present invention would not change if one or more components (or elements) were added to or removed from diagram 800.

Overview for Air Pipe and Transfer Rod

Embodiments of the present invention disclose a paintball assembly capable of channeling pressurized air or gas via an air line or pipe inside of the paintball assembly using a transfer rod. The assembly includes a main valve, an air pipe, a bolt, a hammer, and a U-shaped rod. While the main valve is configured to propel a paintball utilizing pressurized gas, the air pipe supplies and channels the pressurized gas to the valve. The bolt guides or pushes the paintball into a firing chamber, and the hammer manages or controls the main valve for propelling the paintball upon pulling of the trigger. The U-shaped rod is used to synchronize the movement of the bolt and the hammer. In one embodiment, the U-shaped rod is configured in such a way that at least a portion of the U-shaped rod is structured around the air pipe to reduce contact with the air pipe.

Figure 9:
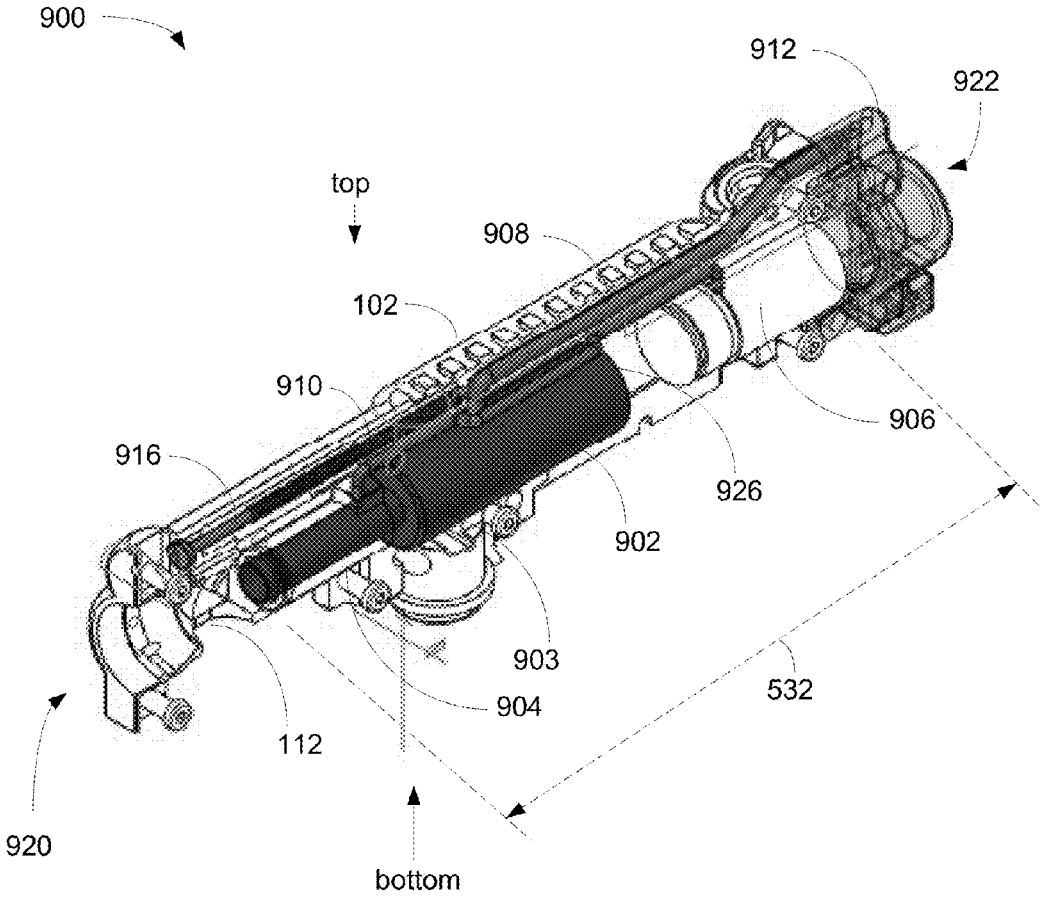
FIG. 9 is a diagram illustrating a perspective view of a receiver having a projectile propelling system utilizing a transfer rod in accordance with one embodiment of the present invention.

FIG. 9 is a diagram 900 illustrating a perspective view of a right side receiver 102 having a projectile propelling system utilizing a transfer rod in accordance with one embodiment of the present invention. Right side receiver 102 includes a projectile propelling system 532, a cocking mechanism 916, a breech receiving end 920, and a back end 922. Breech receiving end 920 is configured to receive the breech end of a gun barrel (not shown in FIG. 9). Back end 922, in one aspect, is configured to fit to a stock or shoulder stock (not shown in FIG. 9). Alternatively, back end 922 is configured to receive gas tank(s) and/or canister(s) (not shown in FIG. 9). It should be noted that the underlying concept of the exemplary embodiment(s) of the present invention would not change if one or more components (or elements) were added to or removed from diagram 900.

Projectile propelling system 532 includes valve 902, bolt 904, hammer 906, air pipe 908, and rod 910. Valve 902, which has also been referred to as main valve, in-line valve, switch, et cetera, is able to launch, propel, throw, or hurl a paintball over a distance using a combination of cocking mechanism and firing mechanism using pressurized gas. Valve 902 controls pressurized gas supplied from air pipe 908 and channels the pressurized gas to propel a paintball over a distance via a barrel. A function of valve 902 is to switch on and/or off pressurized gas in response to the position of trigger.

Valve 902, in one embodiment, is structured in two cylindrical portions including an extended cylindrical portion 903. While main valve 902 controls the pressurized gas, extended cylindrical portion or extended portion 903 provides a track or direction to bolt 904 and provides directional guidance for the movement of bolts 904. Note that valve 902, extended portion 903, bolt 904, and hammer 906 are all axially aligned with the breech end of a barrel. Top surface 926 of valve 902 also coincides with the top orientation of receiver 102.

Air pipe 908 includes several sections wherein a first end is used to coupled to top surface 926 of valve 902 and the second end is used to connect to gas inlet 912 located at back end 922. A first body section of air pipe 908, which is adjacent to the first end of air pipe 908, moves away from the top surface of valve 926 in a perpendicular direction. A second body section of air pipe, which is adjacent to the first body section, is situated in parallel or substantially parallel to the top surface of valve 926. It should be noted that the second body section of air pipe 908 is placed in parallel or substantially parallel with the cylindrical axis of valve 902. A third body section of air pipe 908, which is situated adjacent to gas inlet 912, is configured to couple between the second body section and the second end of air pipe 908. Air pipe 908, in one aspect, is made of solid materials, such as copper, aluminum, nickel, alloy, plastic, composite, metal, and the like.

Transfer rod 910, in one embodiment, is structured in a U-shape or at least a portion of the rod is structured in a U-shape. The U-shaped rod is used to synchronize the movement between bolt 904 and hammer 906. The terms "transfer rod" and "U-shaped rod" are hereinafter referred to the same rod. U-shaped rod 910 includes two ends and several body sections. The first end of U-shaped rod 910 is coupled to bolt 904 and the second end of U-shaped rod 910 is fastened with hammer 906. A first body section of U-shaped rod 910, which is adjacent to the first end of U-shaped rod 910, moves onto the top surface of valve 926 leading away from bolt 904. The U-shaped section of U-shaped rod 910 is used to minimize, reduce, or avoid direct contact with air pipe 908 whereby it can facilitate the movement of bolt 904 and hammer 906 without interfering with air pipe 908. The second body section of U-shaped rod 910, which is adjacent to hammer 906, is used to connect to the second end of U-shaped rod 910. Not that U-shaped rod 910 can be made by any solid or rigid materials, such as metal, copper, aluminum, nickel, alloy, plastic, composite, and the like.

An advantage of employing the embodiment(s) of present invention is that both air pipe 908 and U-shaped rod 910 pass through the top surface of valve 926 without interfering with each other thereby the embodiment(s) allows a user to use a gas source from back end 922.

Figure 10:
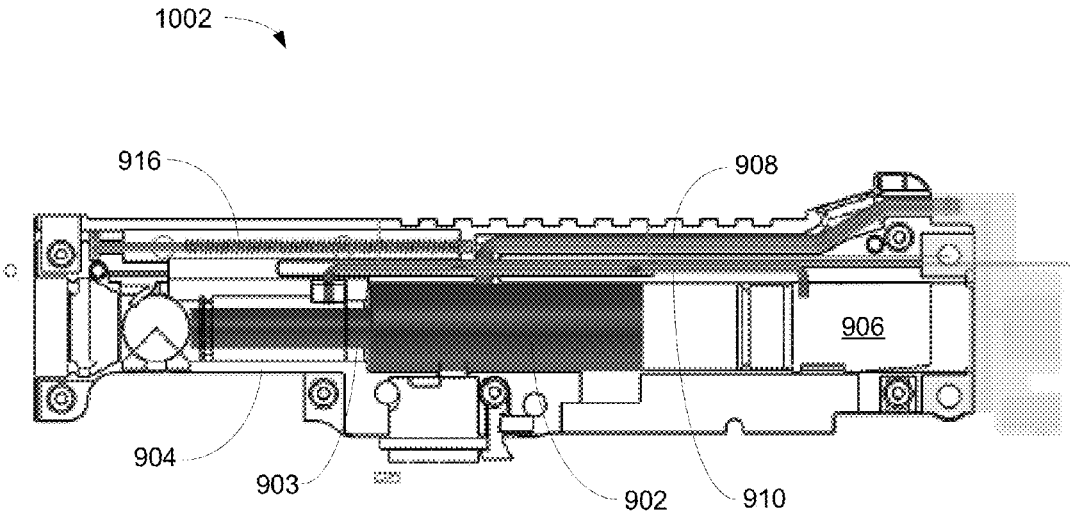
FIG. 10 illustrates diagrams showing a side cross-section view and a front view of a receiver having valve, air pipe, and transfer rod in accordance with one embodiment of the present invention.
Figure 10:
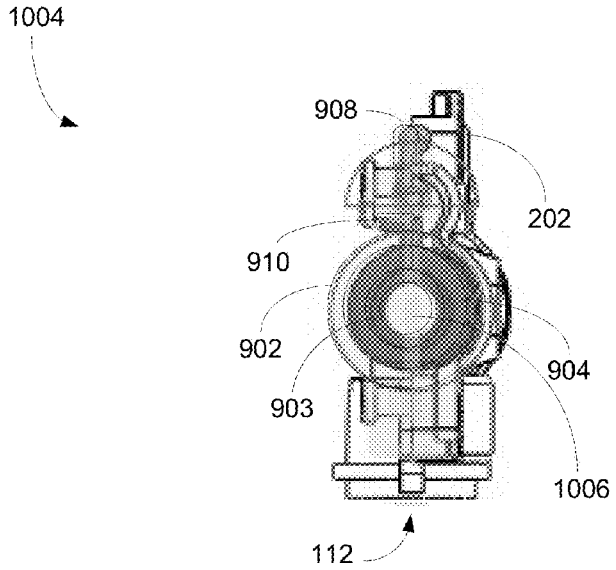

FIG. 10 illustrates diagrams showing a side cross-section view 1002 and a front view 1004 of a receiver having valve 902, air pipe 908, and transfer rod 910 arranged in accordance with one embodiment of the present invention. Front view 1004 illustrates a front perspective view of opening 1006 of extended portion 903, bolt 904, and valve 902. Opening 1006 is a channel allowing a steam of pressurized gas to pass for propelling a paint ball. Bolt 904 is configured to push the paintball into a firing chamber before it is being propelled by the pressurized gas.

During an operation, hammer 906, paintball (not shown in FIG. 10), and valve 902 are axially aligned wherein valve 902 is situated between the paintball and hammer 906. When hammer 906 is in the cocking position and the paintball is loaded, hammer 906 and bolt 904 slide forward upon pulling of a trigger. The forward movement loads the paintball into firing chamber and shoots the paintball over a distance by pressurized gas from air pipe 908. U-shaped rod 910 facilitates movements of hammer 906 and bolt 904 during the firing as well as cocking actions. The U-shaped section of U-shaped rod 910 allows the rod move freely on the top surface of the valve without interfering with air pipe 908.

Figure 11:
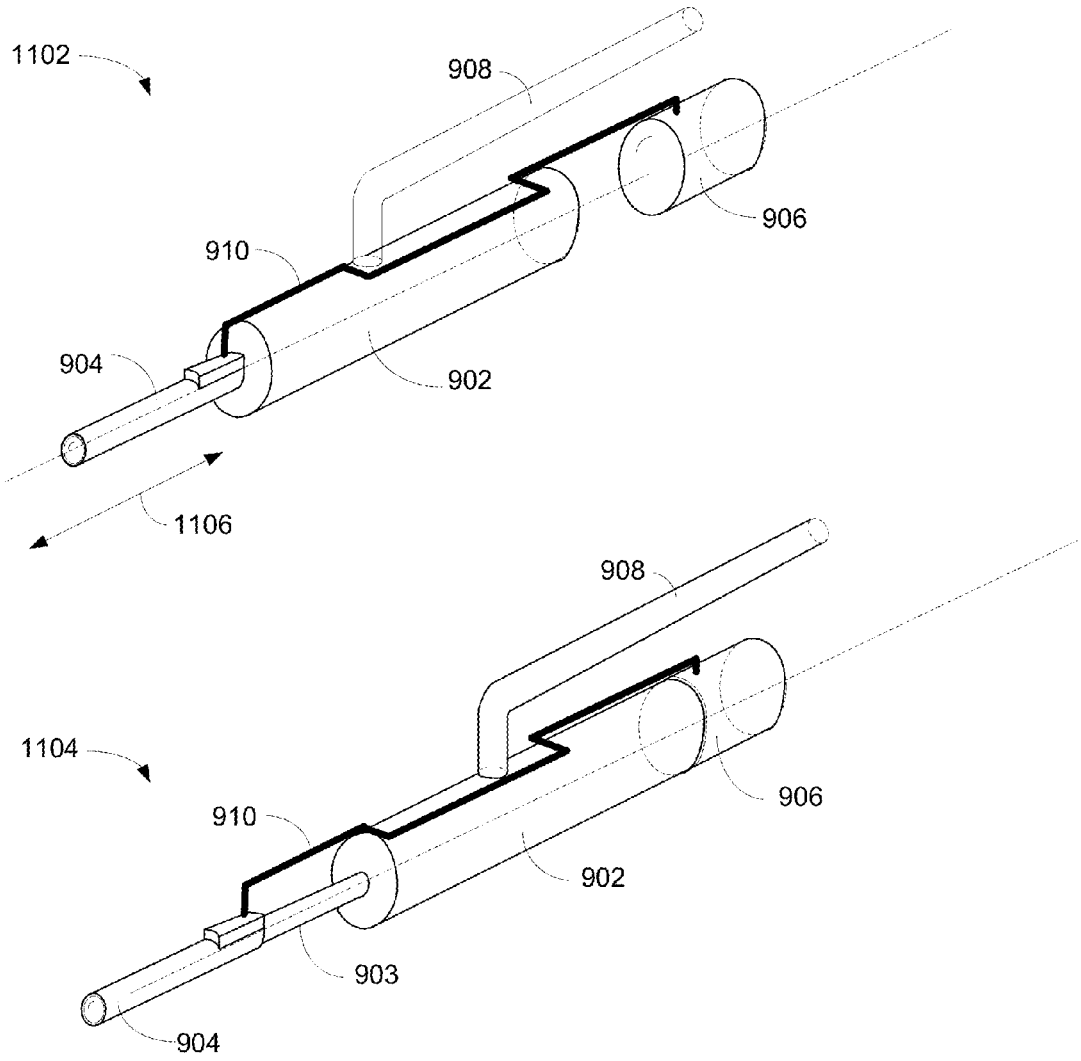
FIG. 11 illustrates diagrams showing simplified perspective views of a propelling mechanism using a transfer rod in accordance with one embodiment of the present invention.

FIG. 11 illustrates diagrams showing simplified perspective views of a propelling mechanism using a transfer rod in accordance with one embodiment of the present invention. Perspective view 1102 shows valve 902, bolt 904, hammer 906, air pipe 908, and U-shaped rod 910, wherein bolt 904 and hammer 906 are in the cocking position. Perspective view 1104 shows bolt 904 and hammer 906 are in the firing position. As illustrated in FIG. 11, the movements of U-shaped rod 910 do not interfere with air pipe 908.

A paintball assembly, in one embodiment, includes valve 902, air pipe 908, bolt 904, hammer 906, and U-shaped rod 910. Valve 902 is configured to propel a paintball using pressurized gas. Valve 902, in one example, is an in-line cylindrical valve having a main cylindrical body and an extended portion 903, wherein the extended portion 903 guides movements or horizontal movement of bolt 904. While bolt 904 is operable to guide the paintball into a firing chamber, hammer 906 is capable of striking valve 902 to release sufficient amount pressurized gas to propel a paintball for a predefined distance.

Air pipe 908 has a first end and a second end, and is able to channel the pressurized gas to valve 902. For example, the first end of air pipe 908 is connected to top surface of valve 902 and the second end of air pipe 902 is connected to a gas source or gas inlet. Note that air pipe 908 is configured to be routed inside of assembly capable of transferring pressurized gas from, for instance, a carbon dioxide canister to valve 902.

U-shaped rod 910 is coupled to bolt 904 and hammer 906, and is configured to synchronize movement of the bolt and the hammer. For example, U-shaped rod 910 has a first end and a second end, wherein the first end of U-shaped rod 910 is fastened to bolt 904 and the second end of U-shaped rod 910 is coupled to hammer 906. In one embodiment, U-shaped rod 910 is configured in such a way that at least a portion of U-shaped rod 910 is structured around air pipe 908 to reduce and/or avoid physical friction with air pipe 908. Note that during the cocking and firing actions, U-shaped rod 910 moves to synchronize the movements 1106 of bolt 904 and hammer 906.

The paintball assembly, in one example, is also configured to include a shoulder stock capable of containing a gas source(s). The gas source may be a nitrogen tank, a carbon dioxide (CO2) canister, and/or a compressed air canister. In an alternative example, the paintball assembly may also include a gas source which is mounted beneath the assembly.

Figure 12:
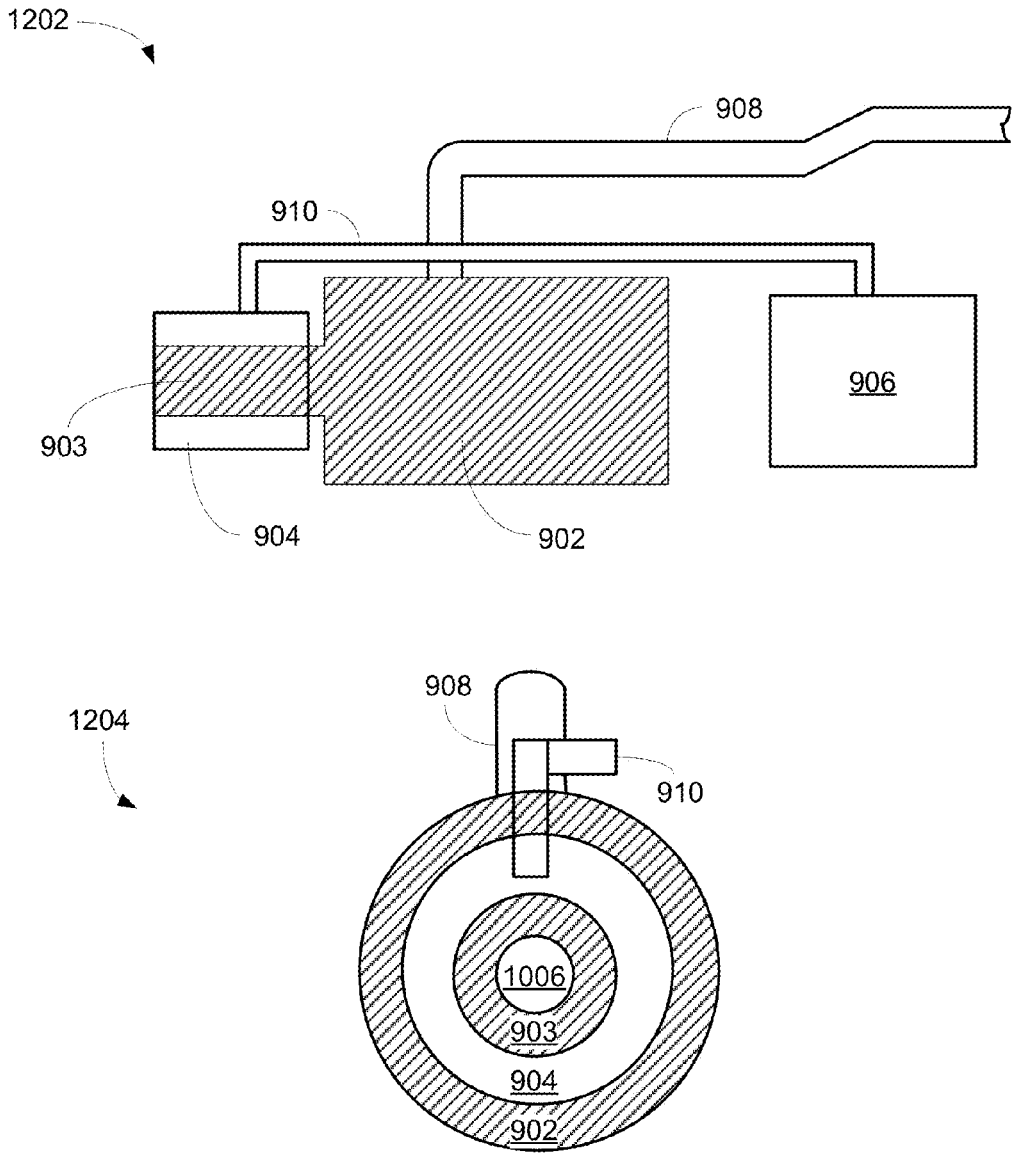
FIG. 12, which is a simplified version of FIG. 10, illustrates diagrams showing a side cross-section view and a front view of a receiver having valve, air pipe, and transfer rod in accordance with one embodiment of the present invention.

FIG. 12, which is a simplified version of FIG. 10, illustrates diagrams showing a side cross-section view 1202 and a front view 1204 of a receiver having valve 902, air pipe 908, and transfer rod 910 in accordance with one embodiment of the present invention. Front view 1204 illustrates a front perspective view of opening 1206 of extended portion 903, bolt 904, and valve 902. Opening 1206 is a channel allowing a steam of pressurized gas to pass in order to propel the paint ball. Bolt 904 pushes the paintball into a firing chamber before the pressurized gas propelling the paintball for a distance.

Figure 13:
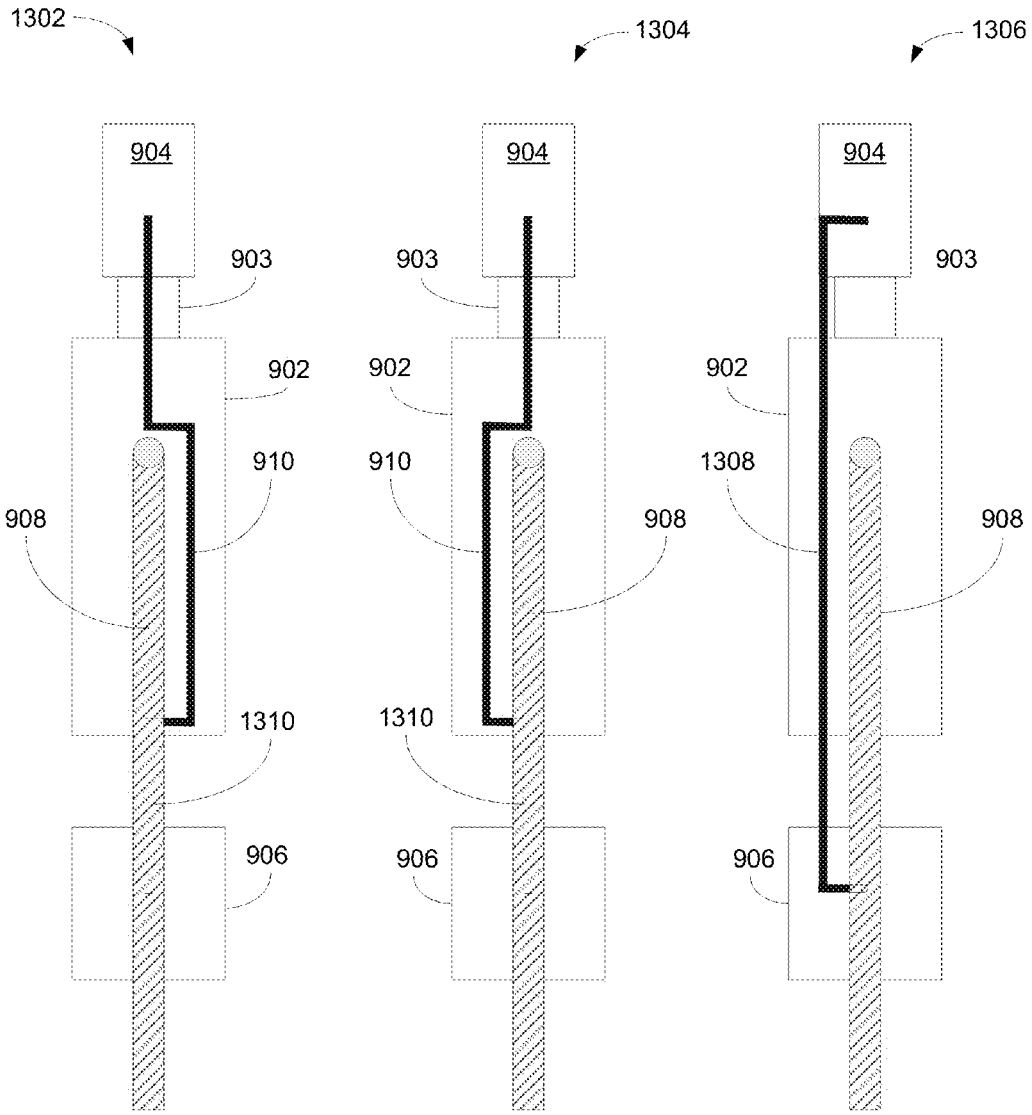
FIG. 13 illustrates diagrams showing top views of alternative aspects of propelling mechanisms including a transfer rod in accordance with one embodiment of the present invention.

FIG. 13 illustrates diagrams showing top views 1302-1306 of alternative aspects of propelling mechanisms including a transfer rod in accordance with one embodiment of the present invention. Top view 1302 illustrates U-shaped rod 910 that moves along at the right side of air pipe 908. A portion 1310 of U-shaped rod moves below air pipe 908. Alternatively, top view 1304 illustrates U-shaped rod 910 that moves along at the left side of air pipe 908. Top view 1306 illustrates an alternatively configured U-shaped rod 1308. It should be noted that other types of U-shaped or V-shaped rod is possible as long as the rod does not interfere with air pipe 908 when it moves back and forth.

Figure 14:
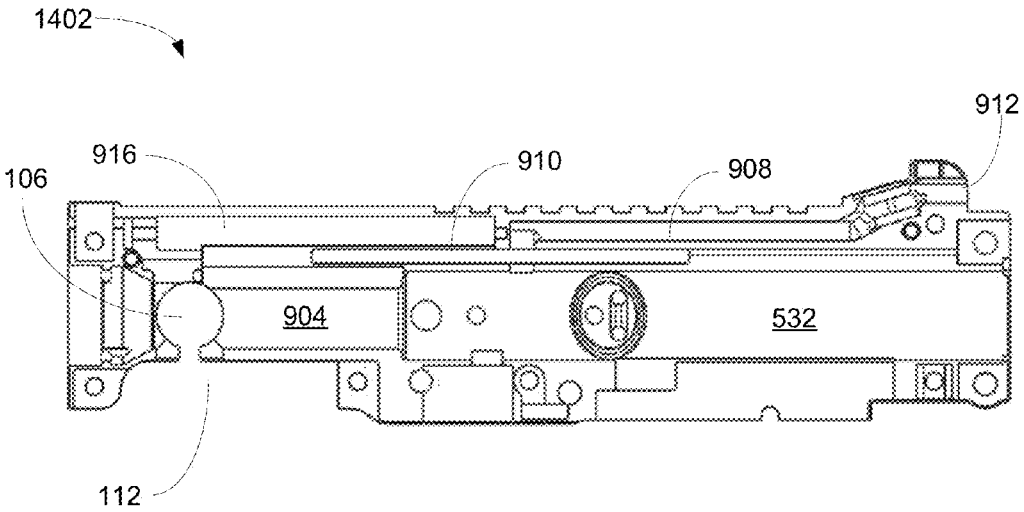
FIG. 14 illustrates diagrams showing cross-section views of a receiver having an air pipe and a transfer rod in accordance with one embodiment of the present invention.
Figure 14:
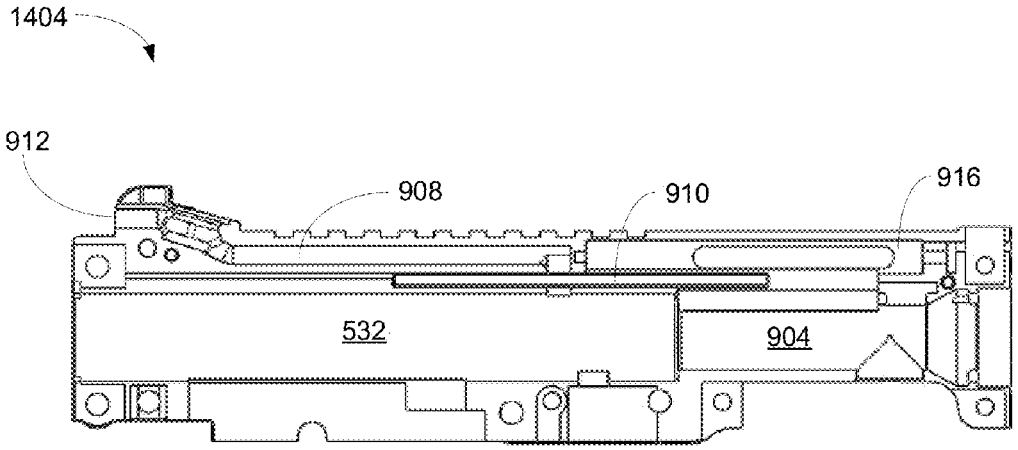

FIG. 14 illustrates diagrams showing cross-section views 1402-1404 of a receiver having air pipe 908 and transfer rod 910 in accordance with one embodiment of the present invention. Cross-section views 1402-1404 includes a receiver, a projectile propelling system 532, air pipe 908, and U-shaped rod 910. In one aspect, inside of receiver is specifically designed with cut-out(s) for air pipe 908 to travel from the top surface of projectile propelling system 532 to gas inlet 912. In one embodiment, gas inlet 912 is used to connect to one or more gas canisters (or tanks) in the stock or shoulder stock.

Figure 15:
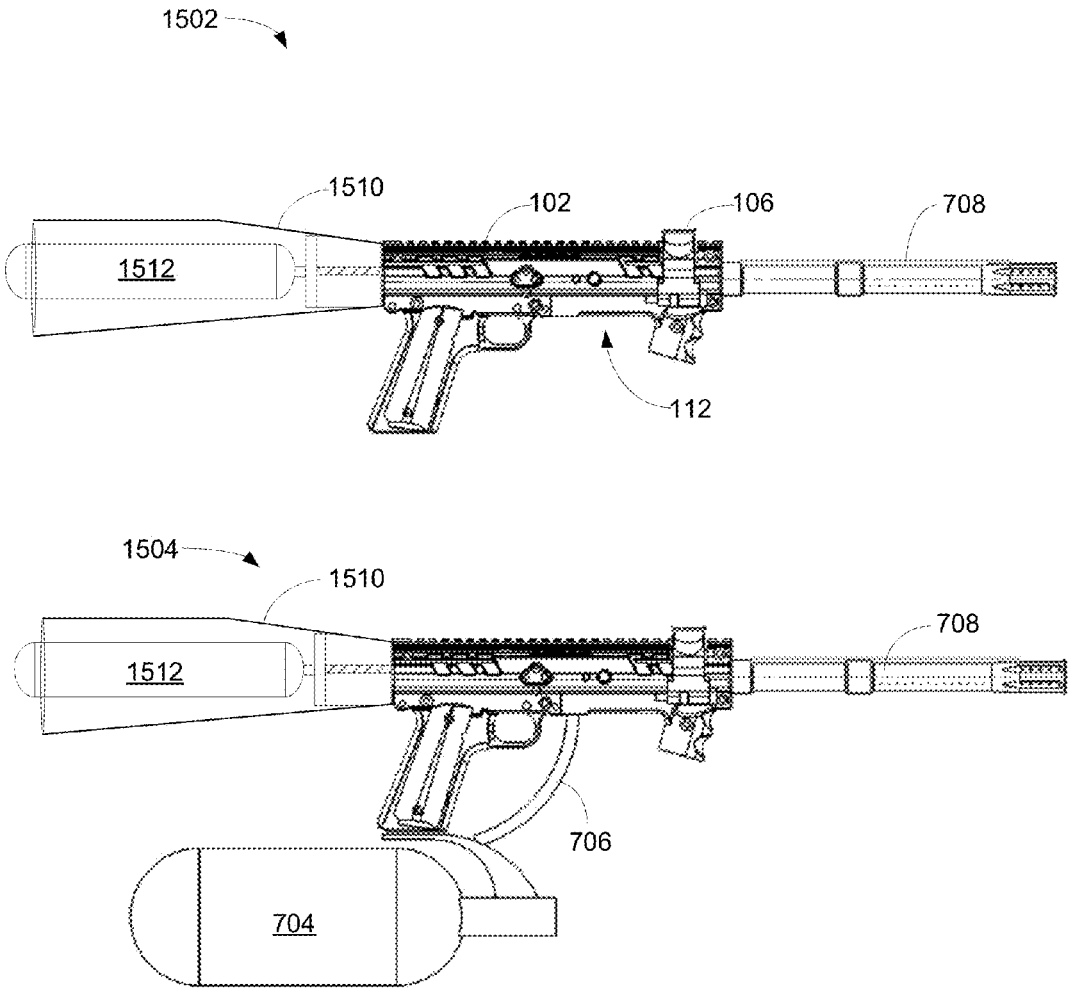
FIG. 15 illustrates paintball assemblies with shoulder stock including a projectile propelling system having a transfer rod in accordance with one embodiment of the present invention.

FIG. 15 illustrates paintball assemblies 1502-1504 with shoulder stocks 1510 including a projectile propelling system having a U-shaped rod in accordance with one embodiment of the present invention. Paintball assembly 1502 shows a receiver, a shoulder stock 1510, a barrel 708, and a grip portion. Shoulder stock 1510, in one aspect, includes one or more gas canisters 1512 configured to be a gas source for paintball assembly 1502. The receiver, in one embodiment, is able to receive paintballs either from top loading or bottom loading and uses pressurized gas to launch the paintball via barrel 708. It should be noted that the underlying concept of the exemplary embodiment(s) of the present invention would not change if one or more components (or elements) were added to or removed from paintball assembly 1502.

Paintball assembly 1504 shows a receiver, a shoulder stock 1510, a stock 1510, a compressed air container 704, a barrel 708, and a gas line 706. In one embodiment, an operator can selectively choose which gas sources to use. For example, the operator can select container 704 as the gas source when canister 1512 is empty. Alternatively, operator can combine the gas sources from container 704 and canister 1512 to reinforce the pressure of gas.

While particular embodiments of the present invention have been shown and described, it will be obvious to those of ordinary skills in the art that based upon the teachings herein, changes and modifications may be made without departing from this exemplary embodiment(s) of the present invention and its broader aspects. Therefore, the appended claims are intended to encompass within their scope all such changes and modifications as are within the true spirit and scope of this exemplary embodiment(s) of the present invention.

What is claimed is:

1. A paintball assembly comprising:

a valve configured to propel a paintball utilizing pressurized gas;

an air pipe, having a first end and a second end, coupled to the valve and able to channel the pressurized gas, wherein the first end of the air pipe is connected to the top surface of the valve and the second end of the air pipe is coupled to a gas source;

a bolt coupled to the valve operable to guide the paintball into a firing chamber;

a hammer coupled to the valve configured to control the valve for propelling the paintball; and a U-shaped rod coupled to the bolt and the hammer and configured to synchronize movement of the bolt and the hammer.

2. The assembly of claim 1, further comprising a shoulder stock coupled to the assembly and configured to contain a gas source.

3. The assembly of claim 2, wherein the gas source includes one of nitrogen tank, carbon dioxide canister, and compressed air canister.

4. The assembly of claim 1, wherein the valve is an in-line cylindrical valve having a main cylindrical body and an extended portion, wherein the extended portion guides horizontal movement of the bolt.

5. The assembly of claim 4, wherein the air pipe is configured to be inside of the assembly transferring pressurized gas from a carbon dioxide canister to the valve.

6. The assembly of claim 5, wherein the U-shaped rod has a first end and a second end, wherein the first end of the U-shaped rod is fastened to the bolt and the second end of the U-shaped rod is coupled to the hammer.

7. The assembly of claim 6, wherein the U-shaped rod is configured in such a way that at least a portion of the U-shaped rod is structured around the air pipe to avoid physical friction with the air pipe.

8. The assembly of claim 7, wherein the U-shaped rod synchronizes movement between the bolt and the hammer during a cocking action.

9. The assembly of claim 7, wherein the U-shaped rod synchronizes movement between the bolt and the hammer during a firing action.

10. A paintball marker comprising:

a valve having a cylindrical body and configured to propel a paintball utilizing pressurized gas;

a first end of an air pipe coupled to the top surface of the valve and able to channel the pressurized gas from a second end of the air pipe to the valve, wherein a first portion of the air pipe adjacent to the first end is situated substantially perpendicular to the top surface of the valve; and a U-shaped rod coupled to the valve and configured to synchronize movement of a bolt and hammer, wherein a U-section of the U-shaped rod is situated adjacent to the first portion of the air pipe and reduces contact between the U-shaped rod and the first portion of the air pipe when the U-shaped rod moves.

11. The paintball marker of claim 10, further comprising a shoulder stock coupled to a receiver of the paintball marker and configured to provider pressurized gas.

12. The paintball marker of claim 11, wherein the valve having a cylindrical body further includes an extended portion which guides movement of the bolt.

13. The paintball marker of claim 12, wherein the second end of an air pipe is connected a gas source inside of the shoulder stock.

14. The paintball marker of claim 13, wherein a second portion of the air pipe is substantially parallel to the top surface of the valve.

15. The paintball marker of claim 10, wherein at least a portion of U-shaped rod is situated in parallel with the top surface of valve.

16. The paintball marker of claim 10, wherein the air pipe and U-shaped rod are made by solid materials.

17. A paintball gun comprising:

a main valve configured to manage pressurized gas for propelling a paintball;

a first end of an air pipe coupled to the top surface of the main valve for providing pressurized gas and a first portion of the air pipe adjacent to the first end of the air pipe is situated substantially perpendicular to the top surface of the valve, wherein a second portion of the air pipe adjacent to the first portion of the air pipe is configured to be substantially parallel to the top surface of the main valve;

a U-shaped rod coupled to the main valve and configured to synchronize movement of a bolt and a hammer, wherein the U-shaped rod is situated adjacent to the first portion of the air pipe and configured in such a way that the U-shaped rod reduces contact to the first portion of the air pipe when the U-shaped rod moves between cocking position and firing position.

18. The paintball marker of claim 17, further comprising a shoulder stock coupled to a receiver of the paintball marker and configured to provider pressured gas.

19. The paintball marker of claim 18, wherein the main valve further includes an extended portion facilitating movement of the bolt.

* * * * *